US010043459B1

(12) United States Patent
de Greef

(10) Patent No.: US 10,043,459 B1
(45) Date of Patent: Aug. 7, 2018

(54) DISPLAY TIMING CONTROLLER WITH SINGLE-FRAME BUFFER MEMORY

(71) Applicant: AMAZON TECHNOLOGIES, INC., Seattle, WA (US)

(72) Inventor: Petrus Maria de Greef, Waalre (NL)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 119 days.

(21) Appl. No.: 15/170,555

(22) Filed: Jun. 1, 2016

(51) Int. Cl.
*G09G 3/34* (2006.01)

(52) U.S. Cl.
CPC ..... *G09G 3/348* (2013.01); *G09G 2310/0202* (2013.01); *G09G 2310/0224* (2013.01); *G09G 2310/0262* (2013.01); *G09G 2310/08* (2013.01); *G09G 2330/023* (2013.01); *G09G 2360/18* (2013.01)

(58) Field of Classification Search
CPC ..... G09G 3/348; G09G 2310/0202; G09G 2310/0224; G09G 2310/0262; G09G 3/3225; G09G 5/001; G09G 2360/18; G09G 2310/08; G09G 2330/023; G02B 26/004
See application file for complete search history.

(56) References Cited

U.S. PATENT DOCUMENTS

2007/0008250 A1* 1/2007 Hoppenbrouwers ..... G09G 3/3225 345/76
2007/0205969 A1* 9/2007 Hagood, IV ..... G02B 26/004 345/84
2010/0007673 A1* 1/2010 Swic ..... G09G 5/001 345/539

* cited by examiner

*Primary Examiner* — Richard Hong
(74) *Attorney, Agent, or Firm* — Brinks Gilson & Lione

(57) ABSTRACT

A display device includes a display timing controller to effect interlaced writing of images to a display panel. The display timing controller includes a single-frame buffer memory and is configured to, during a first frame write time, write odd row image data from odd row memory locations to odd rows of pixels of the display device while simultaneously storing even row image data into even row memory locations while abstaining from overwriting the odd row data. At a second frame write time, the display timing controller writes even row image data from the even row memory locations to the even rows of pixels of the display device while simultaneously storing odd row image data into odd row memory locations while abstaining from overwriting odd row image data.

23 Claims, 11 Drawing Sheets

DISPLAY TIMING CONTROLLER WITH SINGLE-FRAME BUFFER MEMORY

BACKGROUND

Portable electronic devices often include display panels for displaying various types of images. The display panels are often controlled by a display timing controller that selectively drives the pixels of the display panel according to image data stored within a buffer memory of the display timing controller. In many application settings, the buffer memory comprises much, if not most, of the silicon area for a chip-based display timing controller. Moreover, the buffer memory can account for much, if not most, of the overall power consumed by the display timing controller.

Portable electronic devices are typically powered with a portable power source, such as a battery. It is desirable to reduce the power consumed by components within the portable electronic device to extend the useful battery life of the portable electronic device. Further, it is also desirable to reduce the cost associated with production of portable electronic devices and the components within the portable electronic devices.

BRIEF DESCRIPTION OF THE DRAWINGS

The detailed description is described with reference to non-limiting and non-exhaustive embodiments illustrated in the accompanying figures. The same reference numerals in different figures refer to similar or identical items.

DETAILED DESCRIPTION

In example embodiments described herein, a display timing controller includes a single-frame buffer memory. In various embodiments, the display timing controller operates with an interlaced scanning technique where the display timing controller only writes up to one-half of an image frame (e.g., the odd rows or the even rows) to the display panel during a frame write time. The display timing controller handles each one-half of each image frame separately. For example, during a first frame write time, the display timing controller will receive and store even row image data into even row memory locations in the single-frame memory buffer. This occurs while simultaneously reading odd row image data located in odd row memory locations in the single-frame memory buffer (stored during a previous frame write time) and writing the odd row image data to the display panel. During a second frame write time (e.g., the next frame write time), the display timing controller swaps the handling of even and odd row image data by receiving and storing odd row image data into odd row memory locations in the single-frame memory buffer. This occurs while simultaneously reading even row image data located in the even row memory locations in the single-frame memory buffer (stored during the first frame write time) and writing the even row image data to the display panel. This reduces critical timing for storing and reading data from the single-frame buffer memory, which prevents the memory read pointer from overtaking the memory write pointer, which in turn avoids image tearing.

Typical timing controllers may utilize a double-frame buffer memory, which is sized to store at least two full image frames for display on the display panel. However, the present disclosure contemplates a single-frame buffer memory, which is smaller in size and is, in most embodiments, no larger than is required to store the image data of a single image frame, i.e., the single-frame buffer memory is too small to store two complete image frames for a display panel at the same time and can store only a single complete image frame for the display panel. By decreasing the size of the buffer memory (e.g., by one-half), the size, cost, and power consumption of the buffer memory are greatly reduced. The present disclosure provides methods and structures to enable other features that provide additional benefit to the display (for example, increased interlacing intervals resulting in improved perceived brightness), which may not otherwise be available with a single-frame buffer memory.

Further, by utilizing a single-frame buffer memory, the size, cost, and power consumption of the display timing controller can be reduced.

Figure 1:
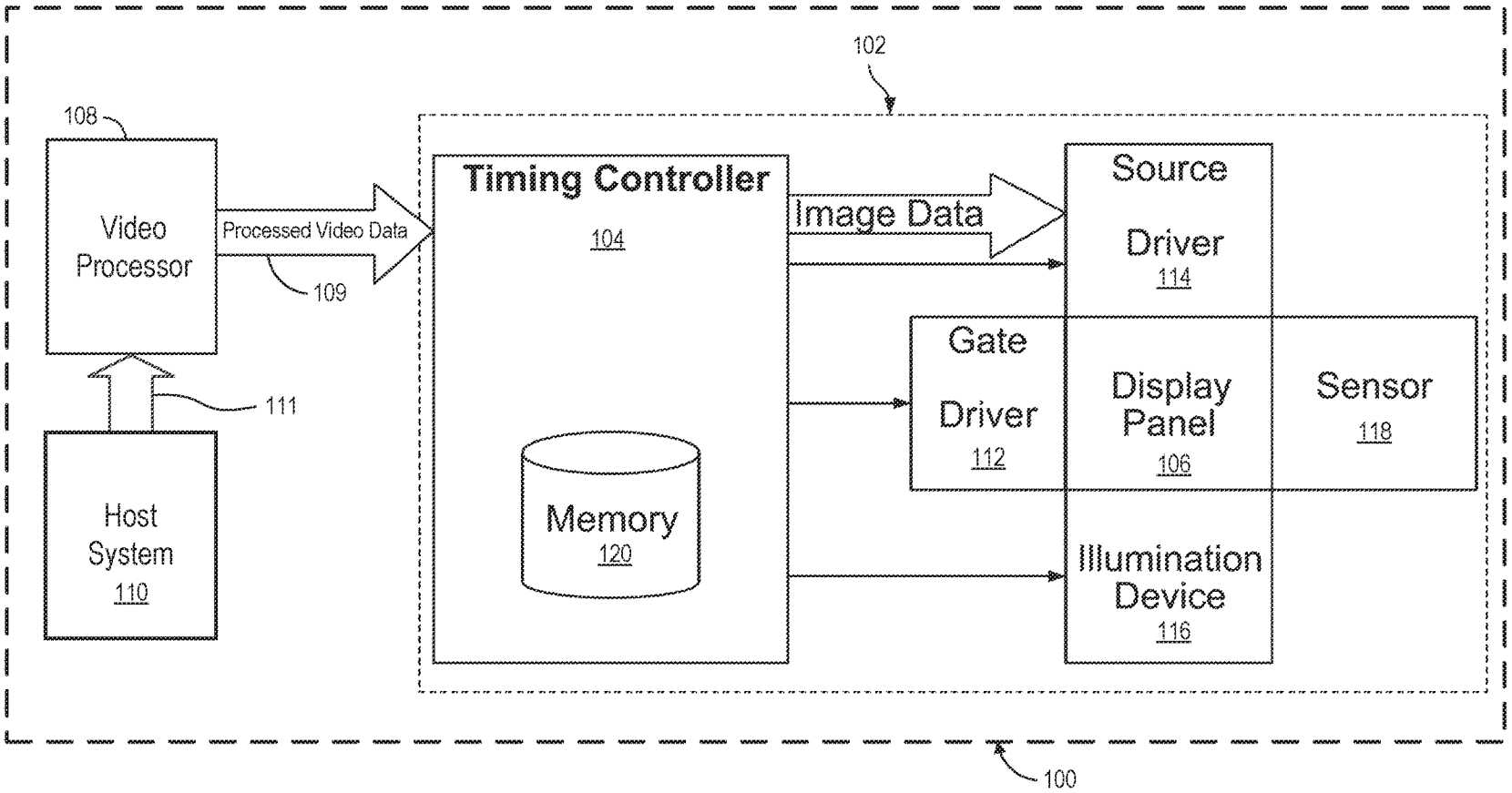
FIG. 1 is a schematic view of a portion of an example electronic device, according to various embodiments.

Referring now to the figures, FIG. 1 schematically illustrates a portion of an example electronic device 100 (e.g., a display device or a portable electronic device) configured in accordance with the present disclosure. Electronic device 100 includes a display assembly 102 that includes a display timing controller 104 and a display panel 106. In various embodiments, display panel 106 is an electrowetting display (EWD) panel, though other display panel types may be suitable, such as liquid crystal displays (LCD), light emitting diode (LED) displays, organic LED (OLED) displays, and plasma displays. An input of display timing controller 104 is coupled to an output of a video processor 108 such that display timing controller 104 receives processed video data 109 from video processor 108. Video processor 108 may receive video or image data from a host system 110. Host system 110 may include a system or a component within electronic device 100 or external to electronic device 100 that is a source of video data 111. For example, host system 110 may include a browser, media player, picture viewer, an e-reader page renderer, an input port or a connector that receives video data 111 from an external source, or any other video source that is capable of generating and/or providing image or video data 111 for display on display panel 106.

Video processor 108 may include one or many dedicated or shared processors (e.g., shared with other elements or components of electronic device 100). Video processor 108 may include a video processing pipeline configured to perform many processing operations on received video data 111 to generate processed video data 109. Processed video data 109 may be video data that is processed and/or converted by the video processor 108 to be specifically compatible with the type and size of display panel 106 such that display timing controller 104 can cause display panel 106 to display an image corresponding to processed video data 109. For example, video processor 108 generates processed complete image frames that are sized for display on display panel 106 and that include data necessary for display timing controller 104 to control operation of each individual pixel to effect display of an image corresponding to the processed complete image frame. Received video data 111 may not be suitable for display on display panel 106 as it may be in an incorrect size, format, and/or resolution, or may include other incompatible or non-optimized features. Further, video processor 108 may generate the processed image frame using additional optimization processing steps that are specifically tailored and suited for optimizing the image for display on display panel 106. Thus, a processed complete image frame is an image frame that has been generated or has otherwise been subject to processing by video processor 108 to convert source received video data 111 into the processed complete image frame or frames for display on the particular display panel 106.

In various embodiments, video processor 108 can only process complete image frames, for example, in progressive format. This is because video processor 108 may perform video processing procedures that require all image content for the frame rather than just half of the data. For example, video processor 108 may perform video processing procedures such as vertical scaling, 2-dimensional error diffusing, filtering, quantization, RGBW conversion, or other video processing procedures. Thus, during the image processing procedures, video processor 108 may need all the even and the odd rows of data to properly process the complete image frame. Accordingly, although video processor 108 may generate the processed complete image frames, in certain embodiments, display timing controller 104 will only use half of the data for each processed complete image frame.

Display panel 106 is made up of a plurality of rows and a plurality of columns of pixel regions, each including an associated pixel. Display timing controller 104 can control display panel 106 to effect display of an image on display panel 106 by controlling row driver 112 (e.g., gate driver or scan driver) and column driver 114 (e.g., source driver or data driver). Display timing controller 104 controls row driver 112 and column driver 114 using one or more addressing schemes that are included in display timing controller 104 as either software or firmware. Display assembly 102, or electronic device 100 in general, may also include an illumination device 116 (e.g., an LED, array of LEDs, or another light source) to illuminate display panel 106. Display assembly 102, or electronic device 100 in general, may also include an ambient light sensor 118 to sense ambient light conditions, according to which display timing controller 104, or another component, can control operations of illumination device 116 and/or display panel 106.

Display timing controller 104 also includes a buffer memory 120. In operation, display timing controller 104 receives video data 109 from video processor 108 (or another source) in the form of an image frame and stores the received image frame in buffer memory 120. When it is time to display a next or subsequent image frame on display panel 106, display timing controller 104 reads the stored image frame out of buffer memory 120 and writes the image frame data to individual pixels of display panel 106 via row driver 112 and column driver 114.

In various applications, display timing controller 104 may utilize a double-frame buffer memory as buffer memory 120. The double-frame buffer memory version of buffer memory 120 is sized to store the data of at least two complete image frames at the same time (though it may store more in certain embodiments). The double-frame buffer memory may include two separate memory devices or may include a single memory device that is partitioned to handle the two complete image frames. In operation, display timing controller 104 reads out a previously stored image frame from the first portion or segment of the double-frame buffer memory and writes that image frame to display panel 106 for displaying. Simultaneously, display timing controller 104 stores an incoming image frame (e.g., processed video data 109) in a second portion or segment of the double-frame buffer memory for display during the next image frame time. After the first set of reading and storing operations, and during the next image frame time, the functions of the two portions of the double-frame buffer memory are reversed. For example, in the next image frame time, the second portion reads out the stored image data to display panel 106 and the first portion stores the next incoming image frame. After this, the functions swap once again, and the process repeats with new incoming image data.

Figure 2:
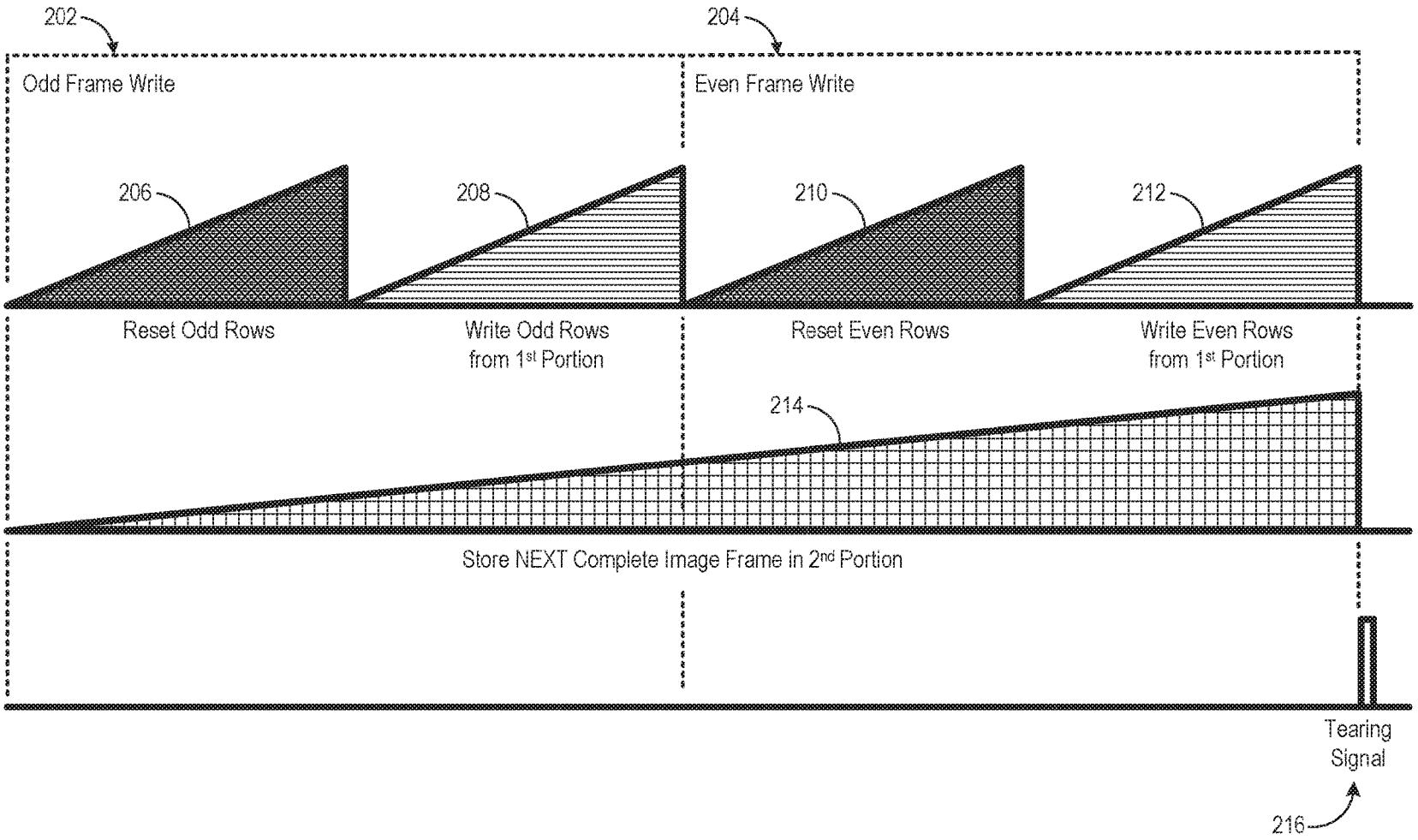
FIG. 2 is an example timing diagram during operation of a display timing controller including a double-frame buffer memory, according to certain embodiments.

Display panel 106 may display images using a progressive scanning technique, where all the rows or all the columns of the display panel are updated or drawn in sequence during a frame write time (e.g., drawing all the rows in order from top to bottom). Conversely, as shown in FIG. 2, an interlaced scanning technique involves updating or drawing the rows or the columns in a non-sequentially manner. In such an approach, display timing controller 104 may also be considered an interlaced display timing controller. For example, as shown in FIG. 2, in an example interlaced scanning technique, display timing controller 104 first writes only the odd rows of an image frame to only the odd rows of display panel 106 during an odd frame write time. Subsequently, display timing controller 104 writes only the even rows of the image frame (or a next image frame) to only the even rows of display panel 106. In this manner, only a portion, e.g., one-half, of display panel 106 (e.g., the even rows or the odd rows) is updated each frame writing time, while the other portion is updated during the next frame writing time. In various embodiments, because display timing controller 104 writes to only half of display panel 106, for example, during a frame writing time, display timing controller 104 can effectively double a frame refresh rate, for example, as compared to a progressive source video stream. In other embodiments, display timing controller 104 can operate at the same frame refresh rate as a progressive source video stream while only updating a portion, e.g., one-half, the data at a time, thereby reducing power consumption of display panel 106 and electronic device 100.

In example embodiments, display panel 106 is an electrowetting display. In these example embodiments, an interlaced scanning technique serves to increase a perceived overall brightness of display panel 106 as compared to a progressive scanning technique. As described herein, electrowetting displays may suffer from backflow, which reduces a luminosity of individual pixels over time after activating a pixel as the opaque oil within the pixel moves from an activated position back toward a resting position, thereby closing the pixel to reduce light throughput. Interlaced scanning techniques reduce the overall effect of a reduction in luminosity (caused by backflow) across the electrowetting display panel by writing to a neighboring collection of rows of pixels with higher overall frequency. This is because individual rows within a neighboring collection of 2, 4, 8, or 16 rows will be updated more frequently at spaced time intervals with an interlaced scanning technique. For example, instead of updating all four neighboring rows 1-4 at approximately the same time using a progressive technique (such that all four rows will experience a decrease in luminosity due to backflow at the same time), display timing controller 104 can update the individual rows with an interlaced technique. For example, display timing controller 104 can first update rows 1 and 3 and then, after a short time (e.g., one-half of a progressive scan update interval), update rows 2 and 4. This avoids a uniform decrease in brightness for the neighboring collection of rows of pixels by spreading the luminosity decrease amongst the different neighboring rows over time, giving the neighboring collection of rows a higher average perceived brightness. The other neighboring collections of rows across display panel 106 are also updated in this same fashion, thereby increasing the overall perceived brightness of display panel 106.

If display panel 106 includes an electrowetting display, display timing controller 104 may perform a pixel reset procedure on each pixel in a row prior to writing a new image to that row. During the pixel reset procedure, display timing controller 104 temporarily drives each pixel (e.g., within the row) with a sufficiently low voltage to temporarily close each pixel (e.g., return the pixel to its resting state wherein the opaque oil covers the pixel surface). After the pixel reset procedure is completed, display timing controller 104 then writes the image data for the next image frame to the individual pixels in the row. The image data for the next image frame for each pixel may specify, for example, that the pixel remains closed (e.g., the pixel remains dark) or that the pixel should be open (e.g., activating the pixel to make the pixel bright), or that the pixel should be placed into a state between open and closed.

FIG. 2 shows an example timing diagram during operation of a display timing controller 104 including a double-frame buffer memory and implementing an interlaced scanning technique for writing to display panel 106. The illustrated example shows an interlaced frame rate being at least twice that of a progressive frame rate for the source video data (e.g., the two interlaced write procedures write an entire source image frame, for example, a 60p source frame rate with 120i display frame rate). In the example timing diagrams within this disclosure, target display panel 106 is assumed to be an electrowetting display panel (thereby including the reset procedures). However, the teachings disclosed herein may apply to other display types as well. Display timing controller 104 splits the process of writing an image frame to display panel 106 into two separate processes.

First, display timing controller 104 performs an odd frame write process during an odd frame write time 202, during which display timing controller 104 writes only odd row image data to only the odd rows of pixels of display panel 106. Second, display timing controller 104 performs an even frame write process during an even frame write time 204, during which display timing controller 104 writes only even row image data to only the even rows of pixels of display panel 106.

Although depicted here and described throughout this disclosure as an odd frame write time 202 occurring before an even write time 204, it should be understood that even frame write time 204 could occur first in the various embodiments. For example, if a complete processed image frame from video processor 108 is to be written to display panel 106 (e.g., in a situation where the display interlaced frame rate is twice that of a progressive source video data), display timing controller 104 could write either the odd image data or the even image data first, and the particular order may not be of significant importance. Further, it should also be understood that, in fact, a subsequent odd frame write time will follow even frame write time 204 in almost all instances as the described process continually repeats itself.

During odd frame write time 202, display timing controller 104 performs an odd reset procedure 206 on the odd rows of pixels of display panel 106. Upon completion of odd reset procedure 206, display timing controller 104 begins reading the odd row image data from a first portion of the double-frame buffer memory and writing 208 that odd row image data to the odd rows of display panel 106. Completion of writing 208 of the odd row image data marks the end of odd frame write time 202 and the beginning of even frame write time 204. During even frame write time 204, display timing controller 104 performs an even reset procedure 210 on the even rows of pixels of display panel 106. Upon completion of even reset procedure 210, display timing controller 104 begins reading the even row image data from the first portion of double-frame buffer memory and writing 212 that even row image data to the even rows of display panel 106.

While display timing controller 104 performs the two write procedures, display timing controller 104 also receives data for the next complete image frame from video processor 108, shown in FIG. 1, (or another source) and stores 214 the data for the next complete image frame into the second portion of the double-frame buffer memory. By storing the incoming next complete image frame data in the second portion of the double-frame buffer memory, display timing controller 104 does not overwrite the image data in the first portion of the double-frame buffer memory (e.g., the image data for the current image frame being written to and displayed by display panel 106) with the incoming next complete image frame data before display timing controller 104 has an opportunity to write the current image data to display panel 106. Upon completion of even frame write time 204, display timing controller 104 may output a tearing signal 216 to video processor 108 to indicate that display timing controller 104 is ready to receive the next complete image frame (e.g., the complete image frame that follows the one stored at time 214).

As illustrated in FIG. 2, display timing controller 104 has an entire duration of two frame write times (e.g., the combined duration of odd frame write time 202 and even frame write time 204) to receive and store the new complete image frame, which is typically sufficient time to safely receive and store the next complete image frame. Further, with a double-frame buffer memory, increasing the discrete interlacing interval (e.g., to INT4, INT8, or INT16; see FIG. 4) will not impact the timing window for receiving and storing the next complete image frame. It should also be understood that, if the interlaced scanning frame rate is equal to the progressive frame rate of the received video data (e.g., 60p source frame rate with 60i display frame rate), display timing controller 104 will only have the duration of one frame write time (e.g., odd frame write time 202 or even frame write time 204) to receive and store the next complete image frame. However, this time will also typically allow display timing controller 104 to receive and store the next complete image frame. Further, with a double-frame buffer memory implementation, as described above, increasing an interlacing interval will not impact the timing window to receive and store the next complete image frame.

In certain embodiments, buffer memory 120 of display timing controller 104 includes a single-frame buffer memory instead of a double-frame buffer memory. A single-frame buffer memory is of a size to store no more than an amount of data approximately equal to (e.g., less than 10% over) a single processed complete image frame from video processor 108 for display on display panel 106. In an alternative embodiment, the single-frame buffer memory is of a size such that it can store less than two processed complete image frames. In this alternative embodiment, the single-frame buffer memory is too small to store two complete image frames for display panel 106 at the same time. Thus, in operation, the single-frame buffer memory can store only a single complete image frame for display panel 106. Because the single-frame buffer memory simultaneously stores and reads data, the single-frame buffer memory may include a dual-port memory configured to read data from the dual-port memory and write data to the dual-port memory simultaneously. In other embodiments, the single-frame buffer memory is configured to perform read operations and store operations at a memory operating frequency that is at least twice as fast as a writing frequency of the display. This helps ensure that for every read operation that occurs at the single-frame buffer memory, the single-frame buffer memory can also perform at least one store operation, which allows data throughput at the speeds necessary to both write to and read from the single-frame buffer memory.

In various embodiments, display timing controller 104 is included within a single chip or an application-specific integrated circuit (ASIC). A double-frame buffer memory can occupy over one-half of a surface area of the ASIC. By replacing the double-frame buffer memory with a single-frame buffer memory, the size of the buffer memory 120 is reduced (e.g., by one-half). This results, for example, in a 30% reduction in an overall size of display timing controller 104 (e.g., in ASIC form) as well as a 30% decrease in power consumed by display timing controller 104. The reduction in size results in a reduction in cost to produce display timing controller 104. Further, because in example embodiments electronic device 100 is portable and utilizes battery power, the reduction in power consumption by display timing controller 104 increases a useable battery life of electronic device 100, which improves user experience and overall impression of electronic device 100.

Figure 3:
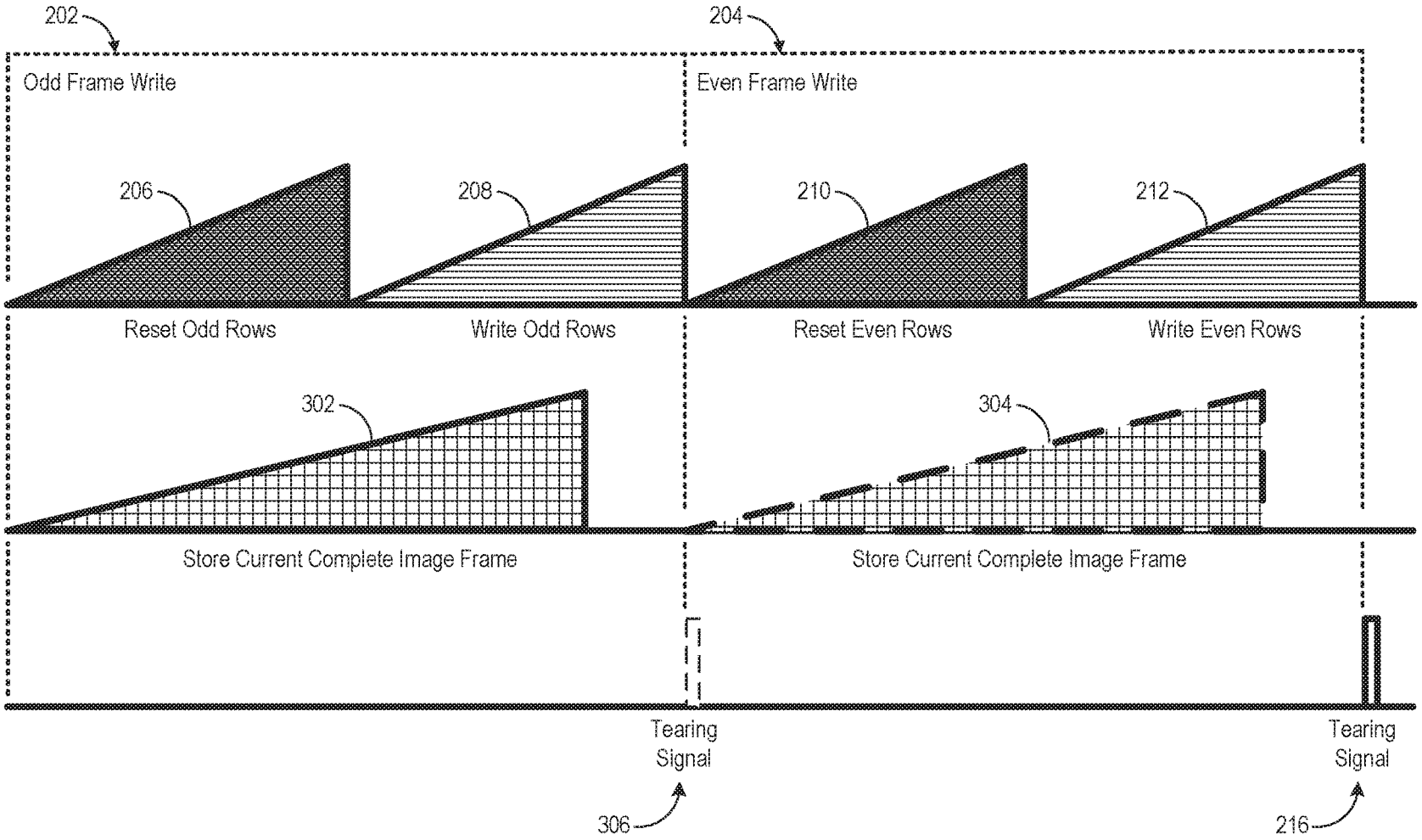
FIG. 3 is an example timing diagram during operation of a display timing controller including a single-frame buffer memory, according to certain embodiments.

FIG. 3 shows an example timing diagram during operation of display timing controller 104 including a single-frame buffer memory and implementing an interlaced scanning technique for writing to display panel 106. As with FIG. 2, display timing controller 104 writes 208 the odd row data to the odd rows of pixels during odd frame write time 202 and writes 212 the even row data to the even rows of pixels during even frame write time 204. However, during operation shown in FIG. 3, display timing controller 104 also receives and stores the current complete image frame during storage time 302 within the same frame write time (e.g., within odd frame write time 202). Because display timing controller 104 receives and stores the current complete image frame within the same frame write time during which it writes the current image frame to display panel 106, display timing controller 104 must complete storing the current complete image frame before it completes writing 208 the image data for that current image frame to display panel 106. Although display timing controller 104 can finish storing the current complete image frame while display timing controller 104 begins to read (and write 208 to the display) that data out to display panel 106, if reading/writing 208 is completed before storage is complete (e.g., if the memory read pointer "overtakes" the memory writing pointer), display timing controller 104 begins to write out data from the previous image frame to display panel 106. This is called image tearing as the image displayed on display panel 106 will appear torn. That is to say, one or more portions (e.g., a top portion) of the image displayed on display panel 106 will show the current image frame, while one or more other portions (e.g., a bottom portion) will show the previous image frame. If the video stream includes movement of high-contrast elements, the tearing effect may be more prevalent and perceptible. Due to the single-frame buffer memory, display timing controller 104 has much more restrictive timing as compared to a double-frame buffering memory implementation, and is therefore more complex and sensitive.

FIG. 3 shows an example operation (in solid lines) where the interlaced frame rate is twice that of the progressive frame rate of the video source (e.g., 60p source frame rate with 120i display frame rate). For example, during even frame write time 204, display timing controller 104 can read out the even row data of the current complete image frame stored at 302 and write 212 that even row data to display panel 106 without loading a new complete image frame. However, FIG. 3 also illustrates an example (in dashed lines) where the interlaced frame rate is equal to the progressive frame rate of the video source (e.g., 60p source frame rate with 60i display frame rate, or a 120p source frame rate with a 120i display frame rate). In such an approach, during even frame write time 204, instead of reading the even row data of the current complete image frame stored during storage time 302, display timing controller 104 will receive (from video processor 108) and store a new current complete image frame at storage time 304. Display timing controller 104 will then read out and write to display panel 106 the even row image data from the new current complete image frame stored just moments before at storage time 304. In such an approach, display timing controller 104 outputs a tearing signal 306 at the completion of odd frame write time 202 and tearing signal 216 at the completion of even frame write time 204.

Figure 4:
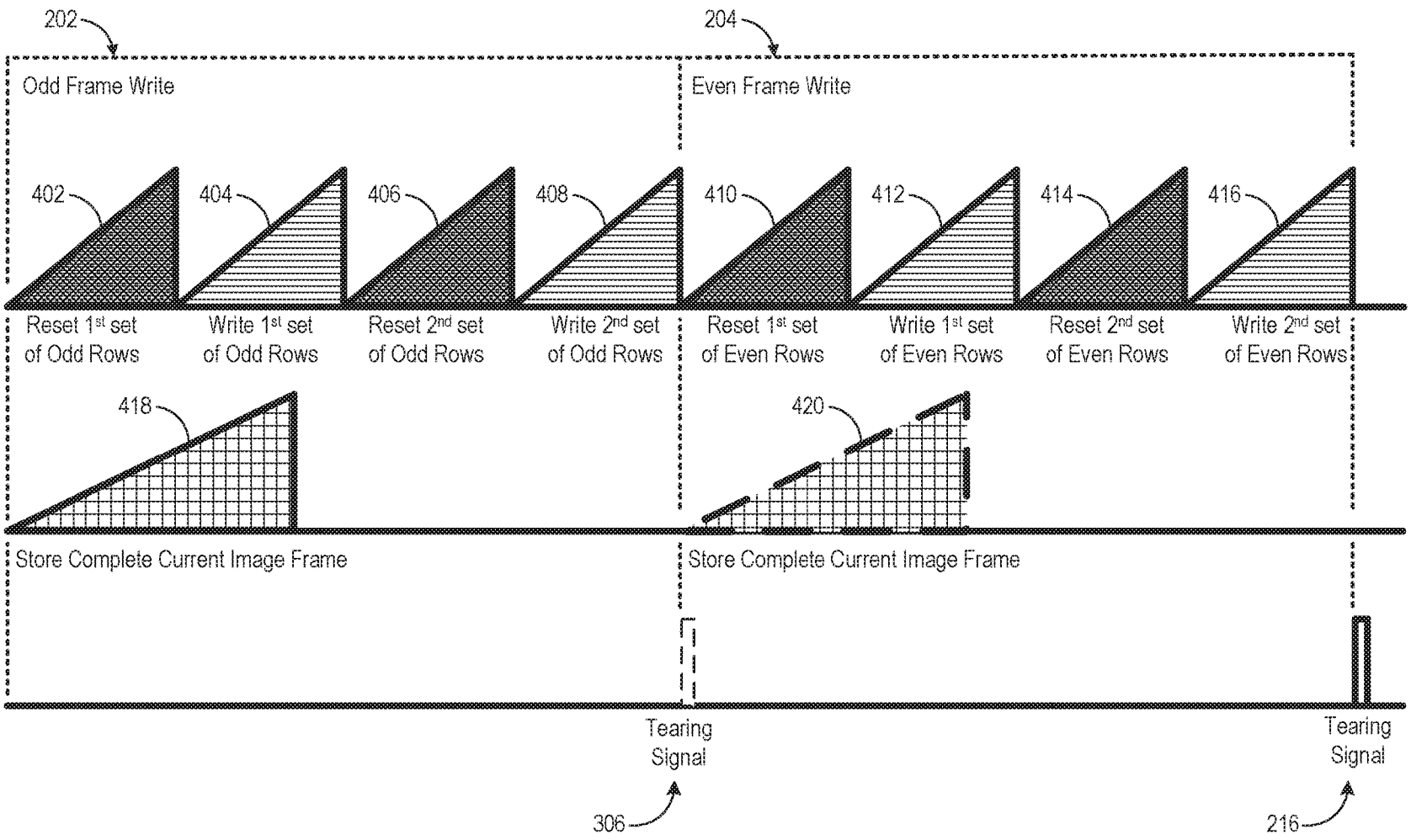
FIG. 4 is another example timing diagram during operation of a display timing controller including a single-frame buffer memory, according to certain embodiments.

FIG. 4 shows another example timing diagram during operation of display timing controller 104 including a single-frame buffer memory and implementing an interlaced scanning technique for writing to display panel 106. In FIG. 4, display timing controller 104 operates in a similar fashion as shown in FIG. 3. However, in FIG. 4, display timing controller 104 is operating at a higher discrete interlacing interval (i.e., INT4). In this example embodiment, display timing controller 104 breaks the odd rows into two separate subsets of odd rows such that every fourth pixel is included in each subset. For example, the first subset includes rows 1, 5, 9, 13, etc., while the second subset includes rows 3, 7, 11, 15, etc. Display timing controller 104 similarly breaks up the even rows. Other interlacing intervals are possible. For example, in INT8 interlacing interval, display timing controller 104 breaks the odd rows into four separate subsets of odd rows such that every eighth pixel is included in each subset (e.g., first subset including rows 1, 9, 17, 25, etc.; second subset including rows 5, 13, 21, 29, etc.; third subset including rows 3, 11, 19, 27, etc.; fourth subset including rows 7, 15, 23, 31, etc.). Display timing controller 104 breaks up the even rows similarly. This interlacing interval concept extends up to INT16 and higher interlacing intervals, as well. Many other discrete interlacing intervals are possible, as well, including odd discrete interlacing intervals (e.g., INT3, INT5, or INT7) and other even discrete interlacing intervals (e.g., INT6, INT10, or INT12).

In the illustrated example INT4 interlacing interval, during odd frame write time 202, display timing controller 104 performs a first reset procedure 402 on the first subset of odd rows and subsequently writes 404 the first subset of odd row data to the corresponding first subset of odd rows of pixels. After that, display timing controller 104 performs a second reset procedure 406 on the second subset of odd rows and subsequently writes 408 the second subset of odd row data to the corresponding second subset of odd rows of pixels, the completion of which marks the end of odd frame write time 202 and the beginning of even frame write time 204. During even frame write time 204, display timing controller 104 performs a third reset procedure 410 on the first subset of even rows and subsequently writes 412 the first subset of even row data to the corresponding first subset of even rows of pixels. After that, display timing controller 104 performs a fourth reset procedure 414 on the second subset of even rows and subsequently writes 416 the second subset of even row data to the corresponding second subset of even rows of pixels.

Similar to the example timing diagram in FIG. 3, the example timing diagram in FIG. 4 shows display timing controller 104 also receiving and storing 418 the current complete image frame within the same frame write time (e.g., within odd frame write time 202) during which it writes the current image frame to display panel 106.

As discussed above with respect to FIG. 3, FIG. 4 shows an example embodiment (in solid lines) where the interlaced frame rate is twice that of the progressive frame rate of the video source. FIG. 4 also shows an example embodiment (in dashed lines) where the frame rate is equal to the progressive frame rate of the video source. In such an approach, during even frame write time 204, instead of reading the even row data of the current complete image frame stored at 418, display timing controller 104 will receive (from video processor 108) and store a new current complete image frame at 420. Display timing controller 104 will then read out and write to display panel 106 the even row image data from the new current complete image frame stored just moments before at 420. In such an approach, display timing controller 104 outputs a tearing signal 306 at the completion of odd frame write time 202 and tearing signal 216 at the completion of even frame write time 204.

As discussed above, display timing controller 104 must complete storing 418 (or storing 420) the current complete image frame before it completes writing 404 (or writing 412) the image data for that current image frame to display panel 106, otherwise image tearing will occur (that is, the read pointer overtakes the write pointer). However, with a higher interlacing interval (e.g., the illustrated INT4 or higher), the timing becomes tighter and more critical. For example, as compared with the example embodiment in FIG. 3, display timing controller 104 has about one-half the time to complete storing 418 the current complete image frame before the read pointer overtakes the write pointer and image tearing occurs.

Although the perceived brightness of display panel 106 may be improved with increasing interlacing intervals, the timing for storing 418 the current complete image data and writing 404 and writing 408 of the odd frames (or the even frames) becomes even tighter and more critical. Accordingly, in various embodiments, the interlacing interval may be limited by this timing such that higher interlacing intervals (e.g., INT 8 and INT16) may not be achievable at certain frame rates. As discussed above, display timing controller 104 is not subject to such tighter timing with increasing interlacing intervals while using a double-frame buffer memory. However, the use of a single-frame buffer memory brings other benefits not realized with a double-frame buffer memory (e.g., decreased size, cost, and power consumption). In the following embodiment, display timing controller 104 is configured to make use of a single-frame buffer memory while also reducing or eliminating the timing effects of using increased interlacing intervals (e.g., INT4, INT8, INT16, and higher).

To achieve higher interlacing intervals while continuing to use a single-frame buffer memory, display timing controller 104 may receive and store each one-half (e.g., the even one-half or the odd one-half) of an image frame separately. The following embodiments are different from the preceding embodiments because, in the preceding embodiments, display timing controller 104 receives and stores a complete image frame (e.g., including both the odd one-half and the even one-half) at one time as a progressive image frame.

Figure 5:
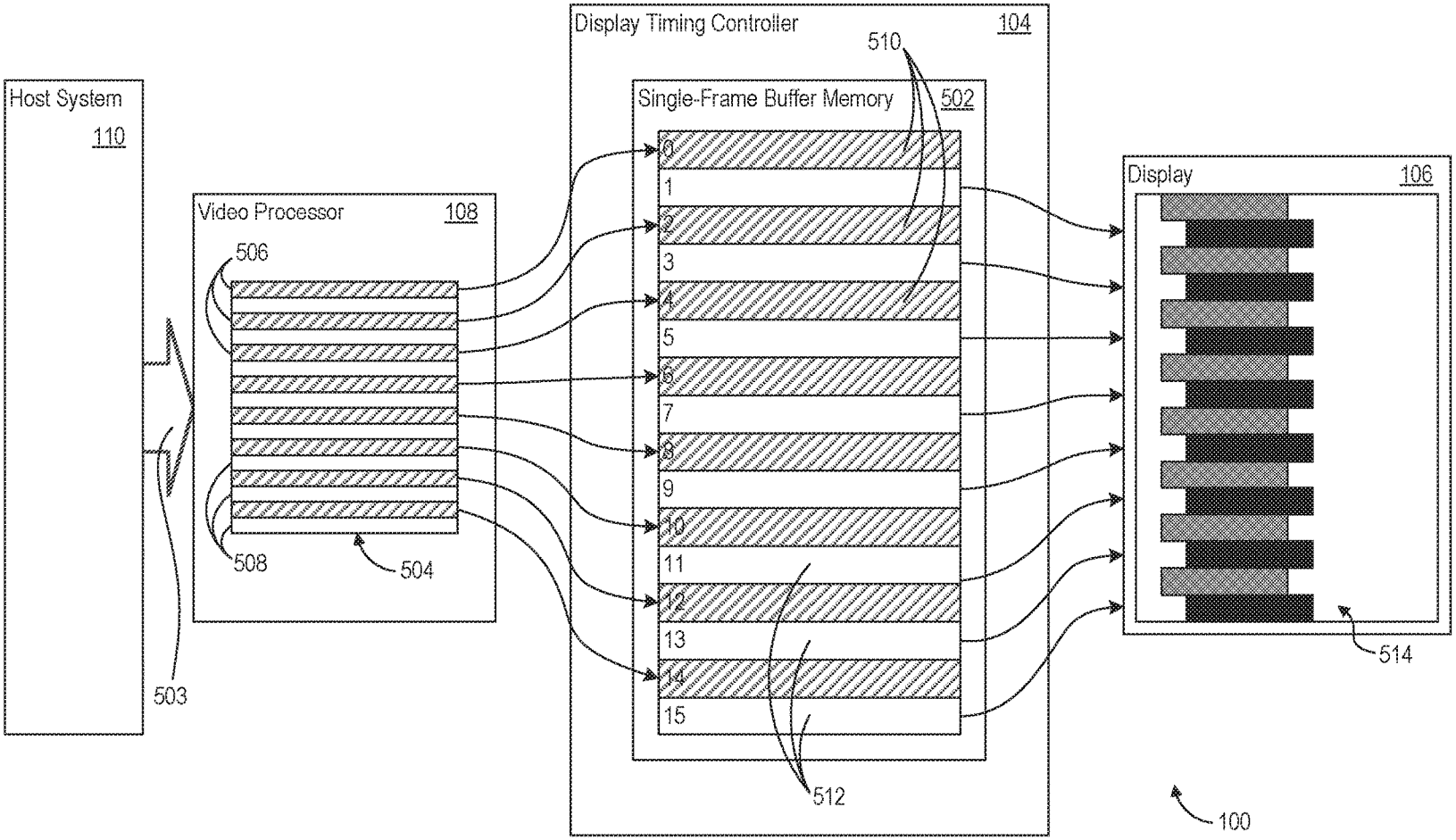
FIG. 5 is a schematic illustration of an example electronic device including a single-frame buffer memory during operation, according to certain embodiments.
Figure 6:
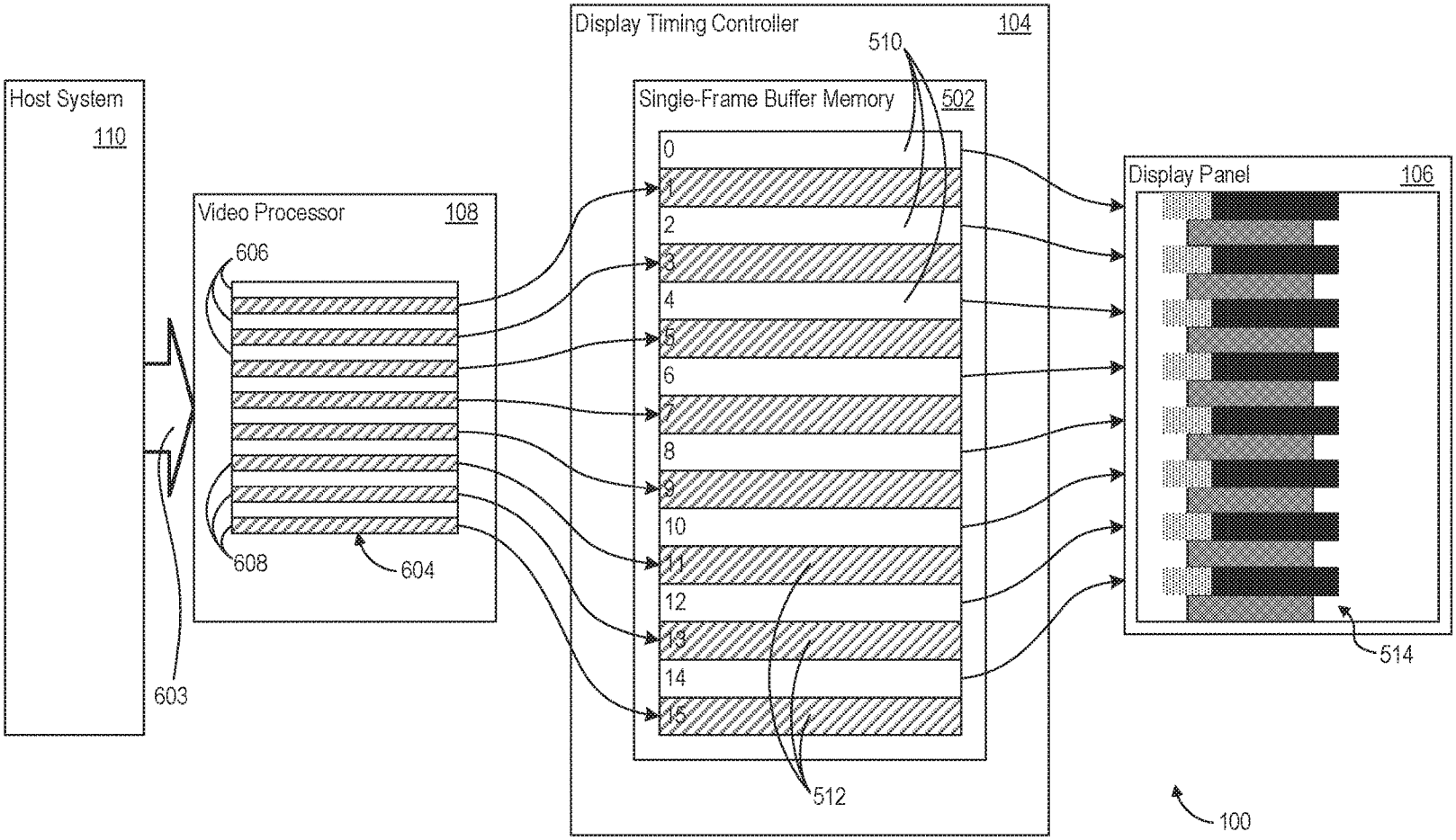
FIG. 6 is another schematic illustration of the example electronic device of FIG. 5 including a single-frame buffer memory during operation, according to certain embodiments.

FIGS. 5 and 6 show a schematic illustration of electronic device 100 including a single-frame buffer memory 502 during operation in accordance with various embodiments. FIG. 5 illustrates operations of electronic device 100 during an odd frame write time (e.g., odd frame write time 202), while FIG. 6 illustrates operations of electronic device 100 during an even frame write time (e.g., even frame write time 204).

Referring first to FIG. 5, host system 110 provides a first complete image frame 503 (e.g., as source video data 111) to video processor 108. Video processor 108 performs a series of image processing procedures on first complete image frame 503 to generate a first processed complete image frame 504. The first processed complete image frame 504 includes even row image data 506 corresponding to the plurality of even rows of pixels of display panel 106 and first image frame odd row image data 508 corresponding to the plurality of odd rows of pixels of display panel 106. During odd frame write time 202, video processor 108 communicates even row image data 506 to display timing controller 104. Video processor 108 does not communicate the first image frame odd row image data 508 to display timing controller 104 during odd frame write time 202. In this manner, video processor 108 communicates strings of pixel data, where each string corresponds to a different even row of pixels. In an alternative embodiment, video processor 108 sends an entire first processed complete image frame 504, but display timing controller 104 saves only even row pixel data 506 and discards the first image frame odd row pixel data 508.

As shown in FIG. 5, display timing controller 104 receives even row pixel data 506 and stores even row pixel data 506 into single-frame buffer memory 502 at even row memory locations 510 within single-frame buffer memory 502. During odd frame write time 202, display timing controller 104 maintains (e.g., abstains from overwriting or does not overwrite) the existing odd row image data located at odd row memory locations 512. This is because, simultaneous with display timing controller 104 storing even row image data 506 into even row memory locations 510, display timing controller 104 reads the existing odd row pixel data stored at odd row memory locations 512 and writes that odd row pixel data to the odd rows of pixels of display panel 106.

Similarly, FIG. 6 illustrates operations of electronic device 100 during an even frame write time (e.g., even frame write time 204) in accordance with various embodiments. Host system 110 provides a second complete image frame 603 (e.g., as source video data 111) to video processor 108. Video processor 108 performs a series of image processing procedures on second complete image frame 603 to generate a second processed complete image frame 604. Second processed complete image frame 604 also includes even row image data 606 corresponding to the plurality of even rows of pixels of display panel 106 and odd row image data 608 corresponding to the plurality of odd rows of pixels of display panel 106.

During even frame write time 204, video processor 108 communicates odd row image data 608 to display timing controller 104. Video processor 108 does not communicate even row image data 606 to display timing controller 104 during even frame write time 204. In an alternative embodiment, video processor 108 sends an entire second processed complete image frame 604, but display timing controller 104 saves only odd row image data 608 and discards unused even row image data 606.

Display timing controller 104 receives odd row image data 608 and stores odd row image data 608 into single-frame buffer memory 502 at odd row memory locations 512 within single-frame buffer memory 502. During even frame write time 204 (shown in FIG. 6), display timing controller 104 maintains the existing even row image data located at even row memory locations 510. This is because, simultaneous with display timing controller 104 storing new odd row image data 608 into odd row memory locations 512, display timing controller 104 also reads the existing even row pixel data stored at even row memory locations 510 and writes that even row pixel data to the even rows of pixels of display panel 106.

In the above process discussed with reference to FIG. 6, the interlaced scanning frame rate is equal to the progressive frame rate of the received video data (e.g., 60p source frame rate with 60i display frame rate). In this example embodiment, every interlaced frame write process involves writing only one-half of a new processed image frame from video processor 108. The other one-half of that processed image frame is unused such that it is never displayed on display panel 106 and is simply discarded. Thus, if a series of image frames (e.g., a video stream) shows a high-contrast object moving across display panel 106, the image may appear with interlacing artifacts or with an interlacing effect (also motion blur), as illustrated by displayed image 514 shown in FIG. 5 and displayed image 614 shown in FIG. 6.

However, in an alternative embodiment, the interlaced scanning frame rate is twice the progressive frame rate of the received video data (e.g., 60p source frame rate with 120i display frame rate). In this embodiment, display timing controller 104 receives from video processor 108 both the even image data and the odd image data (at two separate times) and none of the data from the processed complete image frame is discarded. In such embodiment, instead of video processor 108 receiving second complete image frame 603 and generating second processed complete image frame 604, video processor 108 keeps first processed complete image frame 504 and provides display timing controller 104 with the first image frame odd row image data 508 from first processed complete image frame 504 during even frame write time 204. In this manner, displayed image 514 and displayed image 614 displayed on display panel 106 will, during at least segments of time, include a complete version (e.g., a sharp version) of the image without the interlacing effect, as shown in FIGS. 5 and 6.

So configured, display timing controller 104 only receives and stores in single-frame buffer memory 502 the one-half (e.g., the odd one-half or the even one-half) of the image data that it needs to perform the next interlaced image frame write procedure. Display timing controller 104 does not overwrite the one-half that it is currently reading and writing to display panel 106 during the current frame write time. In this manner, display timing controller 104 does not waste memory space or storing operations on image data that display timing controller 104 will not use or that is redundant.

Figure 7:
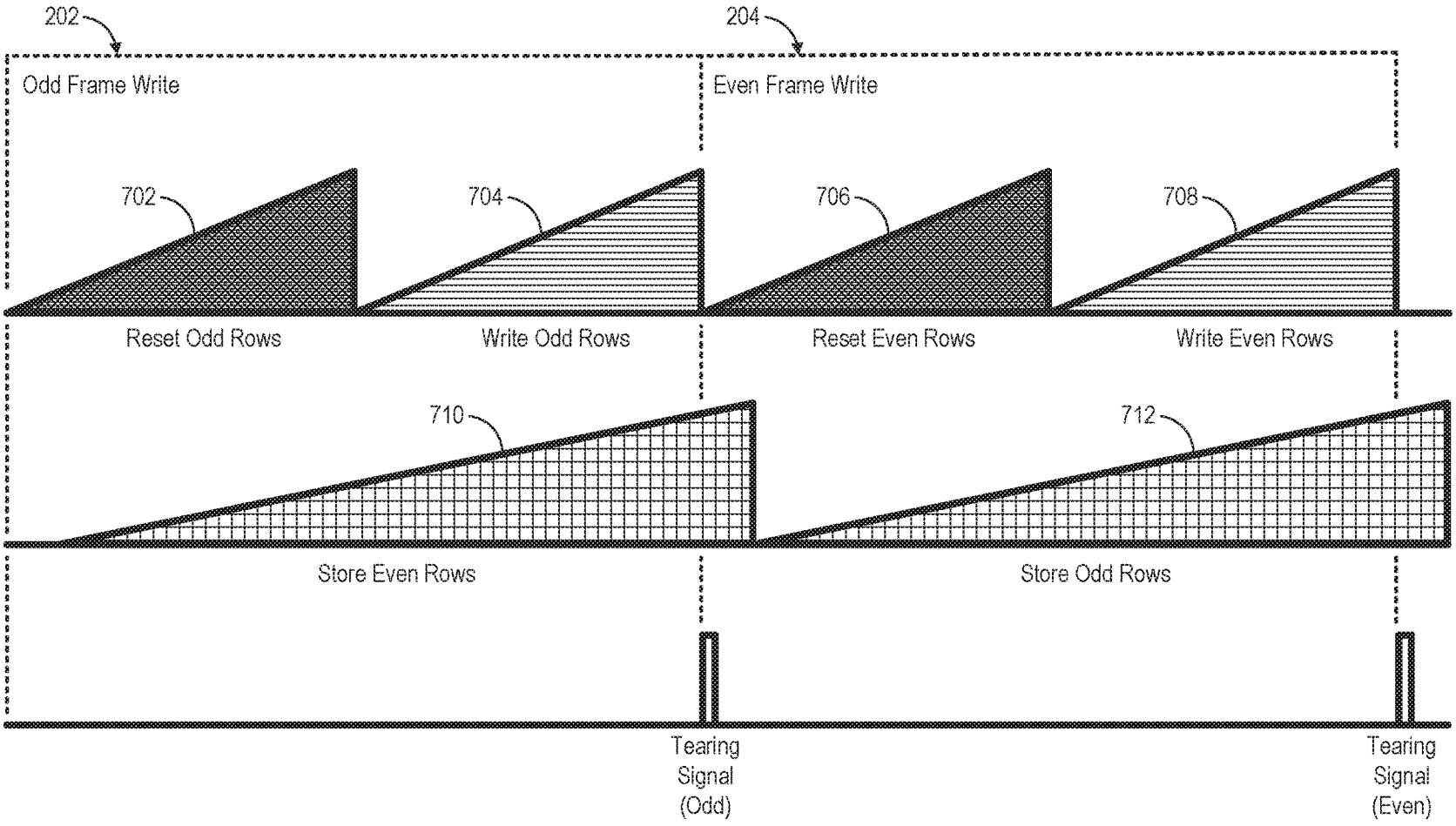
FIG. 7 is another example timing diagram of the operation of an example display timing controller including a single-frame buffer memory, according to certain embodiments.

FIG. 7 shows a timing diagram illustrating the interlaced frame writing procedure with a single-frame buffer memory as discussed above with reference to FIGS. 5 and 6. During odd frame write time 202, display timing controller 104 resets 702 the odd rows of pixels and subsequently writes 704 odd row data to display panel 106. Simultaneously, display timing controller 104 also receives and stores 710 even row image data 506 into even row memory locations 510 in single-frame buffer memory 502. The completion of writing 704 the odd row data marks the completion of odd frame write time 202 and the beginning of even frame write time 204. However, as shown in FIG. 7, display timing controller 104 can actually continue to store the even row data after the completion of odd frame write time 202. Display timing controller 104 must complete storing 710 the even row data before display timing controller 104 begins reading and writing 708 from individual even rows memory locations 510 in subsequent even frame write time 204. In this embodiment, display timing controller 104 completes storing the even row data for a particular even row memory location 510 before display timing controller 104 writes the data in that same even row memory location 510 to display panel 106 (e.g., to prevent the memory read pointer from overtaking the memory write pointer) so as to avoid image tearing.

Figure 8:
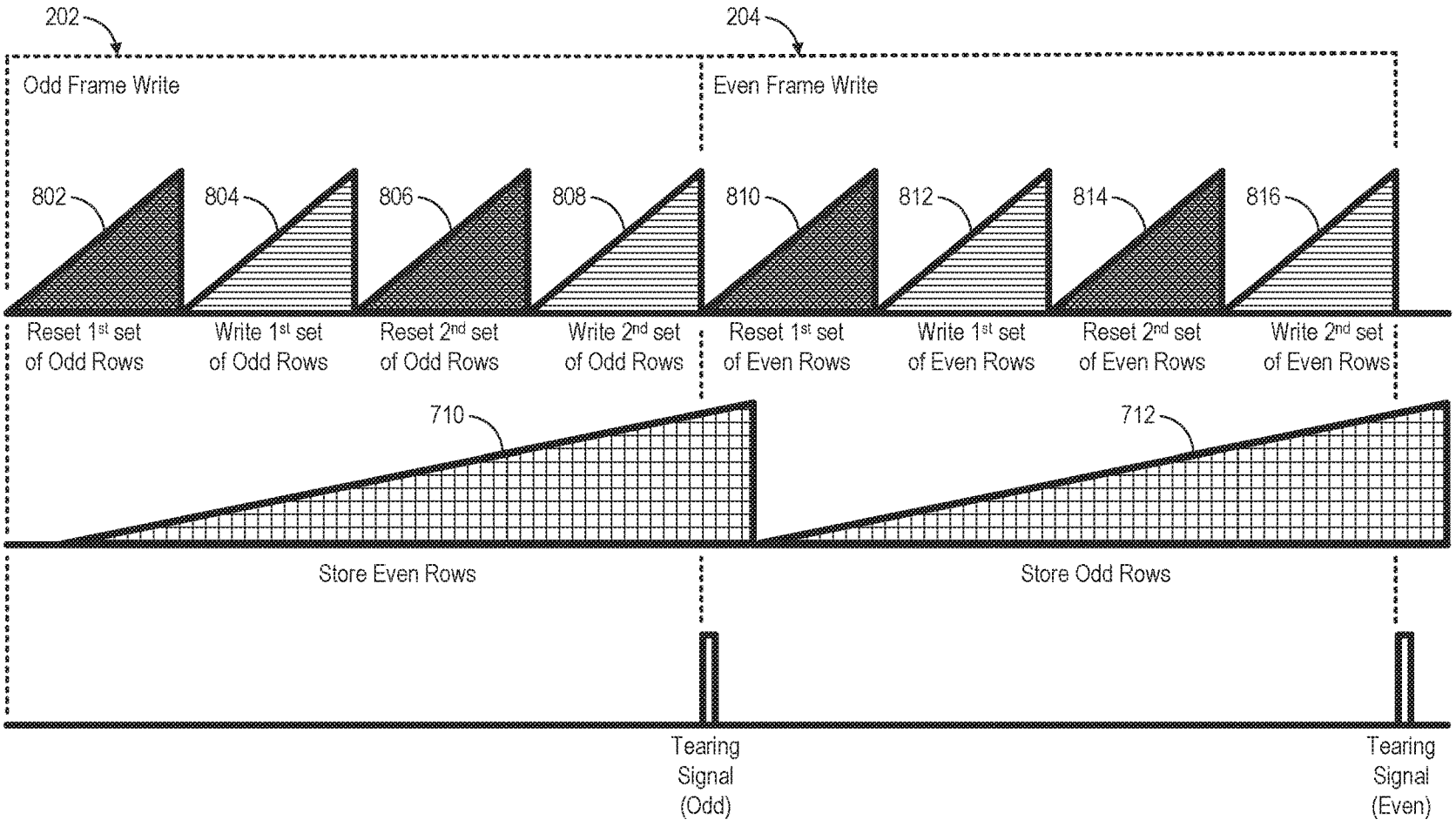
FIG. 8 is another example timing diagram of the operation of an example display timing controller including a single-frame buffer memory, according to certain embodiments.

FIG. 8 shows another timing diagram illustrating the single-frame buffer memory application with an increased interlacing interval. The process of writing the interlaced images to display panel 106 is much the same as discussed above with reference to FIG. 4. During odd frame write time 202, display timing controller 104 performs a first reset procedure 802 on the first subset of odd rows and subsequently writes 804 the first subset of odd row data to the corresponding first subset of odd rows of pixels. Display timing controller 104 then performs a second reset procedure 806 on the second subset of odd rows and subsequently writes 808 the second subset of odd row data to the corresponding second subset of odd rows of pixels, the completion of which marks the end of odd frame write time 202 and the beginning of even frame write time 204. During even frame write time 204, display timing controller 104 performs a third reset procedure 810 on the first subset of even rows and subsequently writes 812 the first subset of even row data to the corresponding first subset of even rows of pixels. Display timing controller 104 then performs a fourth reset procedure 814 on the second subset of even rows and subsequently writes 816 the second subset of even row data to the corresponding second subset of even rows of pixels.

With the interlacing intervals grouped as odd or even without intermixing during odd frame write time 202 and even frame write time 204, the interlacing interval can be increased while having minimal or no effect on the timing of storage procedure 710 and storing procedure 712. As shown in FIG. 8 (when compared to FIG. 7), the effect of increasing the interlacing interval has minimal or no effect on the allowed timing for storing procedure 710 and storing procedure 712. However, the present single-frame buffer memory solution described in reference to FIG. 8 does not suffer the same timing restrictions realized with the single-frame memory solution described in reference to FIG. 4. Accordingly, the benefits of utilizing a single-frame buffer memory (e.g., reduced size, cost, and power consumption) can be realized while also utilizing higher interlacing intervals, which result in a higher perceived brightness of display panel 106.

Figure 9:
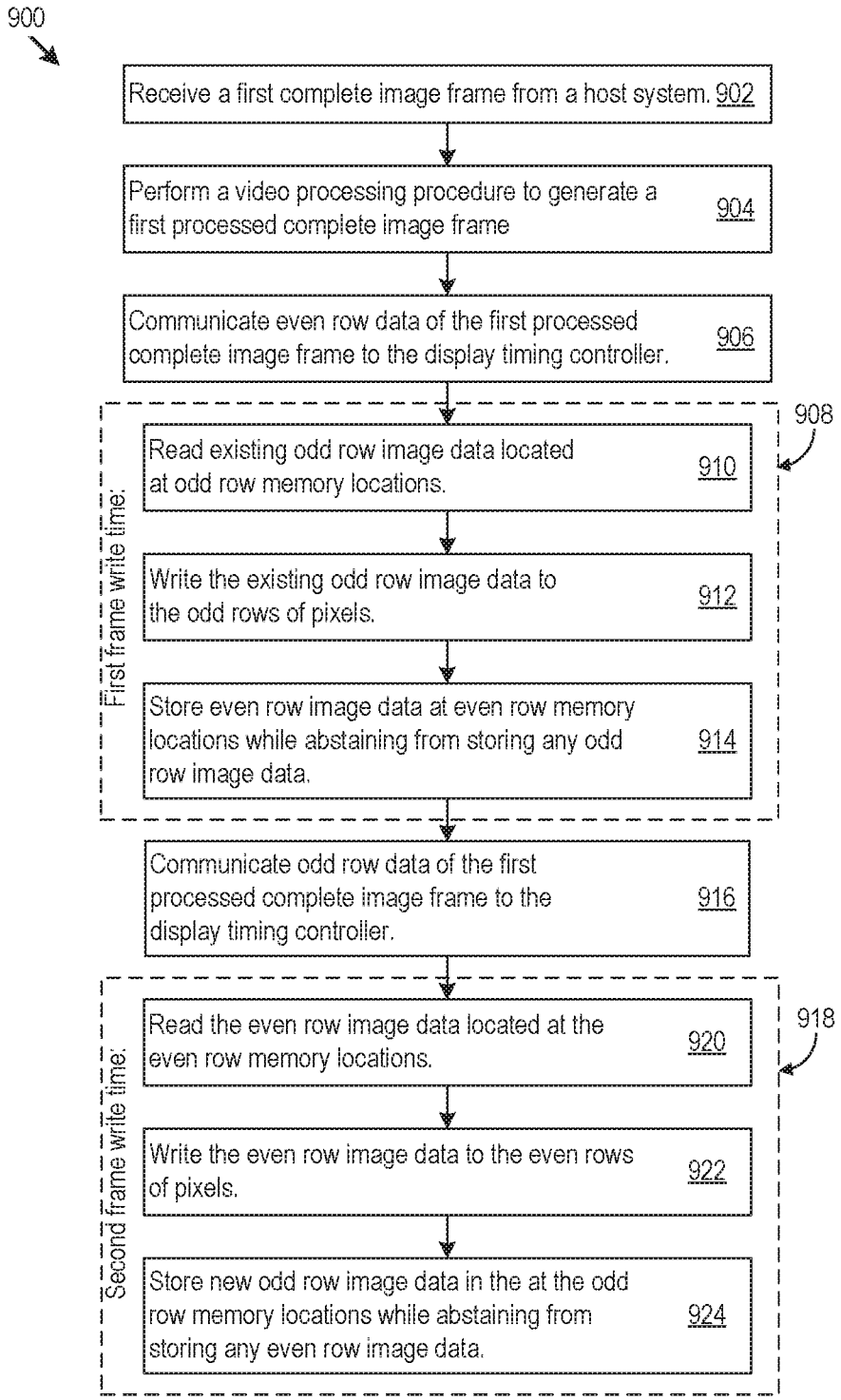
FIG. 9 is a flowchart illustrating an example process for a display timing controller, according to certain embodiments.

FIG. 9 illustrates a flowchart illustrating an example method 900 for performing interlaced writing utilizing a single-frame buffer memory. At step 902, video processor 108 receives a first complete image frame from host system 110. At step 904, video processor 108 performs at least one image processing procedure on the first complete image frame to generate a first processed complete image frame configured for display on display panel 106. At step 906, video processor 108 communicates the even row image data to display timing controller 104 during a first interlaced frame write time. Display timing controller 104 also receives the even row image data of the first processed complete image frame from video processor 108.

During a first interlaced frame write time 908 (e.g., an odd frame write time), at step 910, display timing controller 104 reads existing odd row image data located at a plurality of odd row memory locations within the single-frame buffer memory. In example embodiments, display timing controller 104 reads all odd row image data for a corresponding existing processed complete image frame (i.e., odd row image data for the processed complete image frame directly previous to the first processed complete image frame). At step 912, display timing controller 104 writes the existing odd row image data to the plurality of odd rows of pixels of display panel 106. At step 914, display timing controller 104 stores the even row image data of a first processed complete image frame in the single-frame buffer memory at a plurality of even row memory locations within the single-frame buffer memory, while abstaining from storing any odd row image data of the first processed complete image frame in the single-frame buffer memory.

Depending on the interlaced scanning frame rate as compared to the source data progressive frame rate, video processor 108 and display timing controller 104 may take one of two steps. In one embodiment, the interlaced scanning frame rate is twice as fast as the source data progressive frame rate (e.g., 60p source frame rate with 120i display frame rate). At step 916, video processor 108 communicates the odd row image data of the first processed complete image frame to display timing controller 104 during the second interlaced frame write time. Display timing controller 104, in turn, receives the odd row image data of the first processed complete image frame from video processor 108. More specifically, both the even row data and the odd row data of the first processed complete image frame are communicated from video processor 108 to display timing controller 104 and none of the image data is wasted. This is because the interlaced writing frame rate is twice as fast as the source data progressive frame rate, which allows display timing controller 104 adequate time to display both portions, e.g., both halves, of the image data. An alternative approach where the interlaced scanning frame rate is equal to the source data progressive frame rate is illustrated in FIG. 10 and is discussed below.

During a second interlaced frame write time 918 (e.g., an even frame write time), at step 920, display timing controller 104 reads the even row image data located at the plurality of even row memory locations in the single-frame buffer memory. In certain embodiments, display timing controller 104 reads the entire even row image data for the first processed complete image frame. At step 922, display timing controller 104 writes the even row image data to the plurality of even rows of pixels of display panel 106. At step 924, display timing controller 104 stores the new odd row image data communicated from video processor 108 to display timing controller 104 in step 918 (or in step 1006, see FIG. 10) in the single-frame buffer memory at a plurality of odd row memory locations. Display timing controller 104 also simultaneously maintains (e.g., abstains from overwriting) the even row image data stored in the single-frame buffer memory.

Figure 10:
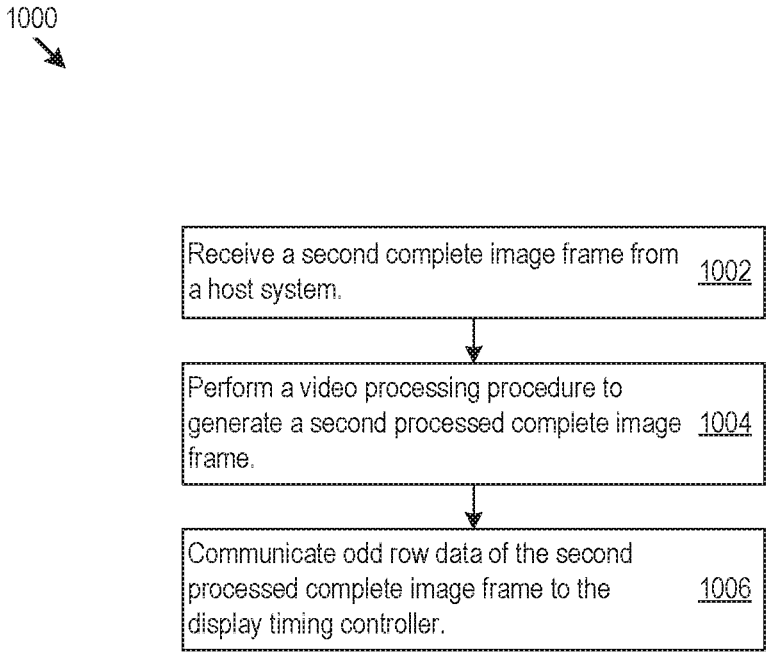
FIG. 10 is a flowchart illustrating example alternative process steps for a display timing controller, according to certain embodiments.

FIG. 10 illustrates an example alternative method 1000 including alternative steps that can replace step 916 shown in FIG. 9. Whereas the embodiment shown in FIG. 9 describes an approach having an interlaced writing frame rate twice as fast as the source data progressive frame rate, the alternative embodiment of FIG. 10 describes an approach having an interlaced scanning frame rate equal to the source data progressive frame rate (e.g., 60p source frame rate with 60i display frame rate). At step 1002, video processor 108 receives a second complete image frame from host system 110. At step 1004, video processor 108 performs at least one image processing procedure on the second complete image frame to generate a second processed complete image frame configured for display on display panel 106. The second processed complete image frame includes new odd row image data corresponding to the plurality of odd rows of pixels. In a particular embodiment, video processor 108 overwrites the previous odd row image data from the first processed complete image frame with the new odd row image data of the second processed complete image frame before video processor 108 sends the previous odd row image data to display timing controller 104, thereby essentially discarding the unused odd row image data from the first processed complete image frame. At step 1006, video processor 108 communicates the new odd row image data of the second processed complete image frame to display timing controller 104 during the second interlaced frame write time. Display timing controller 104 also receives the new odd row image data from video processor 108.

Reference is made throughout to "even" and "odd" rows of pixels or image data. However, it is understood that these terms may be switched such that the processes discussed herein occur first with even data and second with odd data. In fact, most processes will toggle between handling even data and odd data in a similar or identical manner with each step. Further, it is understood that the groupings of rows of pixels are not limited to even or odd, and instead may include any logical groupings of rows or pixels and associated image data. For example, groupings may include every two rows, every three rows, and so forth, or groups of two or more adjacent or non-adjacent rows together. Groupings of rows may not necessarily be broken into two separate groups (e.g., as with even and odd) and may include more than two groups of rows of pixels and may include odd or non-discrete groups of rows of pixels. As such, reference is made herein to a first plurality of rows of pixels and associated first image data, and a second plurality of rows of pixels and associated second image data. In some embodiments, the first plurality of rows of pixels may correspond to either the odd or even rows of pixels, while the second plurality of rows of pixels may correspond to the opposite rows. However, in other embodiments, the first and second pluralities of rows of pixels may correspond to any subset of the rows of pixels and, in certain embodiments, may be only a portion of the rows of pixels of the display (e.g., a third plurality or other pluralities or rows of pixels may, together with the first and second pluralities, form the entire display). In some embodiments, the first and second pluralities of rows of pixels may be selected dynamically, such that their allocations change based on various factors. Further, the single-frame buffer memory may also include a first plurality of memory locations and a second plurality or memory locations instead of odd and even memory locations. Also, like the display, the single-frame buffer memory may be broken into different groups corresponding to different rows of pixels, but may, in certain embodiments, follow or correspond to the groups selected for the rows of pixels of the display. Further, it is understood that the processes discussed herein may be applicable to columns of pixels instead of rows, or may be applicable to groups of rows or columns of pixels or portions of rows or columns of pixels instead of individual rows or columns.

Display panel 106 may comprise an electrowetting display (EWD). When a video stream is to be reproduced on an active matrix EWD, display timing controller 104 and display drivers are used to process the incoming data stream to control the actual pixels of the EWD panel. A specific addressing scheme is used by display timing controller 104 to timely control row and column drivers of the EWD to write the odd rows of pixel data and/or the even rows of pixel data. Display timing controller 104 drives an active matrix transistor array and provides analog voltages to individual pixels of the EWD according to the addressing scheme to set or maintain the pixel state. These voltages modulate the luminance transmission and/or reflectivity of the pixels of the EWD. The pixels are grouped per row and when a row is addressed, voltages of the complete row are provided to the row of pixels by the column driver and stored as charge on corresponding pixel capacitors within the pixels. As the display data is repeatedly updated, still and moving images can be reproduced by the EWD.

In some examples, electronic devices 100 may include one or more components associated with the EWD, such as a touch sensor component layered atop the EWD for detecting touch inputs, and a front light or back light component for lighting the EWD. In the case of a transmissive EWD, a back light may be positioned on or over a rear surface of the EWD. When activated, the back light causes light to pass through the open pixels of the EWD to increase a viewer's perceived brightness of the display. Conversely, if the display is implemented as a reflective EWD, a front light may be positioned on or over a front surface of the EWD and configured to cause light to strike a viewing surface of the EWD. That light will then be reflected out of open pixels to a viewer again increasing the viewer's perceived brightness of the EWD.

An electrowetting pixel is surrounded by a number of pixel walls. The pixel walls form a structure that is configured to contain at least a portion of a first liquid, such as an opaque oil. Light transmission through the electrowetting pixel can be controlled by application of an electric potential or driving voltage to the electrowetting pixel, which results in a movement of a second liquid, such as an electrolyte solution, into the electrowetting pixel, thereby displacing the first liquid.

For a reflective EWD, when the electrowetting pixel is in a resting state (i.e., the closed or off state, with no electric potential applied), the opaque oil is generally distributed throughout the pixel. The oil absorbs light and the pixel in this condition appears dark, e.g., black. But when the pixel is in the active state (i.e., the at least partially open state—the on state—with an electric potential applied), the electrolyte solution displaces the oil so that the oil is no longer covering the whole pixel area. Light can then enter the pixel and strike a reflective surface that would otherwise be obscured by the opaque oil. The light then reflects out of the pixel, causing the pixel to appear less dark, e.g., white, to an observer. If the reflective surface only reflects a portion of the light spectrum or if color filters are incorporated into the pixel structure, the pixel may appear to be grey or have color.

A pixel may, unless otherwise specified, comprise a single sub-pixel or a pixel that includes two or more sub-pixels of an electrowetting display device. Such a pixel or sub-pixel may be the smallest light transmissive, reflective or transflective element of a display that is individually operable to directly control an amount of light transmission through and/or reflection from the element. For example, in some implementations, a pixel may be a pixel that includes a red sub-pixel, a green sub-pixel, a blue sub-pixel and a transparent (white) sub-pixel. In other implementations, a pixel may be a pixel that is a smallest component, e.g., the pixel does not include any sub-pixels.

More particularly, a display device, such as an electrowetting display device, for example, can be a thin film transistor electrowetting display (TFT-EWD) that generally includes an array of transmissive, reflective or transflective pixels or sub-pixels (referred to herein as pixels) configured to be operated by an active matrix addressing scheme. For example, rows and columns of pixels are operated by controlling voltage levels on a plurality of source lines and gate lines. In this fashion, the display device can produce an image by selecting particular pixels to transmit, reflect or block light. Pixels are addressed (e.g., selected) via source lines and gate lines that are connected to transistors (e.g., TFT structures used as switches) included in or associated with each pixel. Transistors take up a relatively small fraction of the area of each pixel. For example, the transistor can be located underneath the reflector in reflective displays.

An EWD employs an applied voltage to change the surface tension of a liquid in relation to a surface. For instance, by applying a voltage to a hydrophobic surface via a pixel electrode in conjunction with a common electrode, the wetting properties of the surface can be modified so that the surface becomes increasingly hydrophilic. Hydrophobic generally refers to repelling water or polar fluids while hydrophilic generally refers to having an affinity for water or polar fluids. As one example of an electrowetting display, the modification of the surface tension by applying a voltage causes a fluid that includes an electrolyte, i.e., the polar fluid, in an electrowetting liquid in individual pixels of the display to adhere to the modified surface and, thus, replace an electrowetting oil layer in individual pixels of the display. Thus, the electrowetting fluids in the individual pixels of the display responding to the change in surface tension act as an optical switch. When the voltage is absent, the electrowetting oil forms a continuous film within a pixel, and the color may thus be visible to a user of the display. On the other hand, when the voltage is applied to the pixel, the electrowetting oil is displaced and the pixel becomes reflective. When multiple pixels of the display are independently activated, the display can present a color or grayscale image. The pixels may form the basis for a transmissive, reflective, or transmissive/reflective (transreflective) display. Further, the pixels may be responsive to high switching speeds (e.g., on the order of several milliseconds), while employing small pixel dimensions. Accordingly, the electrowetting displays described herein may be suitable for applications such as displaying video content. In addition, the low power consumption of electrowetting displays in general makes the technology suitable for displaying content on portable display devices that rely on battery power.

In general, image display apparatuses, such as, for example, various electronic devices, including, but not limited to, portable computing devices, tablet computers, laptop computers, notebook computers, mobile phones, personal digital assistants (PDAs), and portable media devices (e.g., e-book devices, DVD players, etc.), display images on a display. Examples of such displays include, but are not limited to, LCDs, EWDs and EPDs.

The EWD may operate in both a display pixel interface (DPI) mode or a display bus interface (DBI) mode, which is suitable for displaying static images, such as e-reader text pages. The particular application or source of the image data (e.g., in host system 110) may dictate the mode in which the display operates. For example, host system 110 may provide streaming video data to the display, in which case a DPI mode may be selected. However, if host system 110 is providing static images, for example, e-reader text pages, a DBI mode may be better suited.

Figure 11:
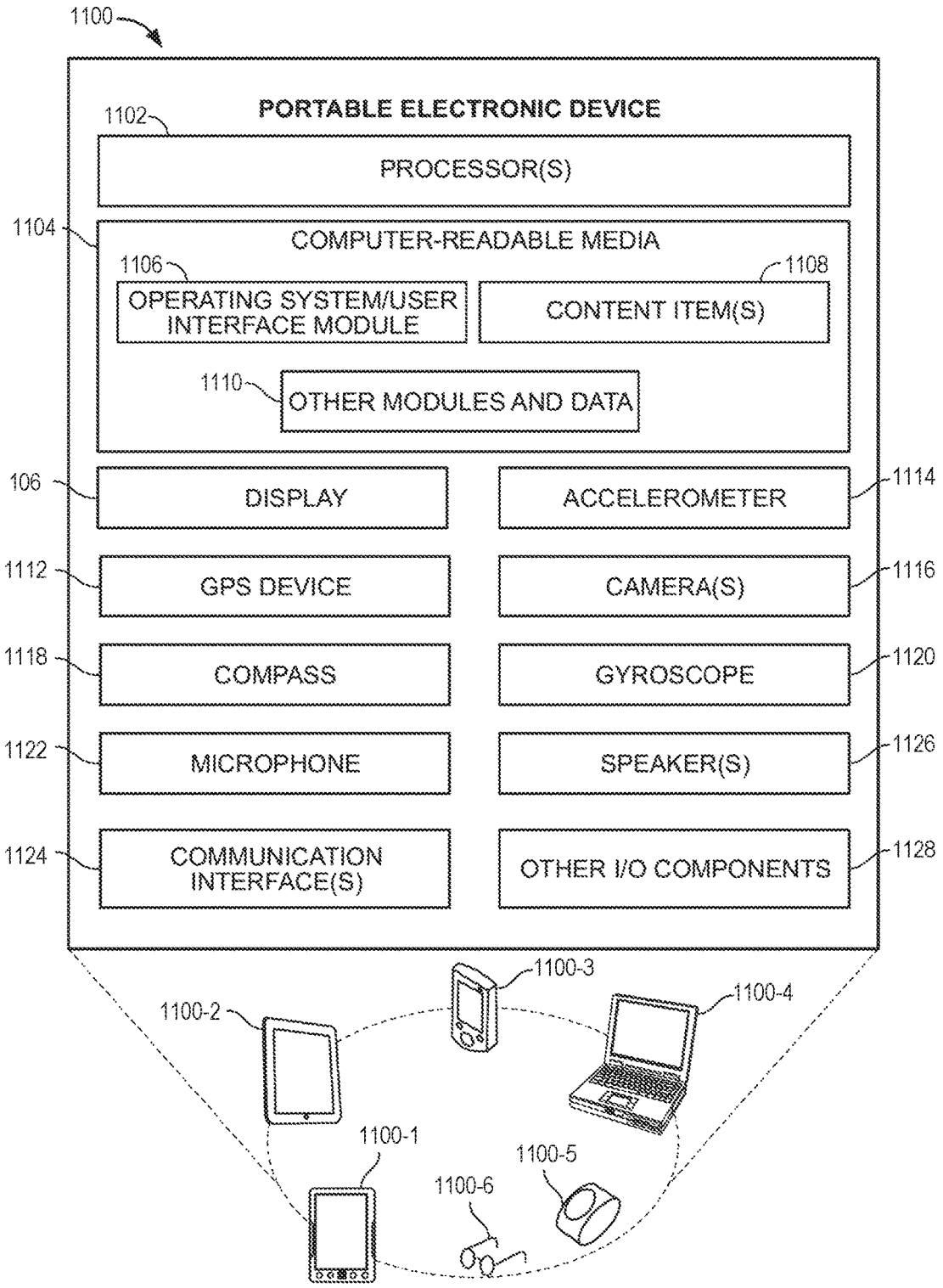
FIG. 11 illustrates select components of an example display device, according to various embodiments.

FIG. 11 illustrates select example components of an example display device 1100 that may be used with display panel 106 according to some implementations. Display panel 106 may be an electrowetting display panel; however, other types of displays may also be used with the example display device 1100. Such types of displays include, but are not limited to, LCDs, cholesteric displays, electrophoretic displays, electrofluidic pixel displays, and photonic ink displays.

Display device 1100 may be implemented as any of a number of different types of electronic devices. Some examples of display device 1100 may include digital media devices and eBook readers 1100-1; tablet computing devices 1100-2; smart phones, mobile devices and portable gaming systems 1100-3; laptop and netbook computing devices 1100-4; wearable computing devices 1100-5; augmented reality devices, helmets, goggles or glasses 1100-6; and any other device capable of connecting with display panel 106 and including a processor and memory for controlling the display according to the techniques described herein.

In one configuration, display device 1100 includes, or accesses, components such as at least one control logic circuit, central processing unit, or processor 1102, and one or more computer-readable media 1104. Each processor 1102 may itself comprise one or more processors or processing cores. For example, processor 1102 can be implemented as one or more microprocessors, microcomputers, microcontrollers, digital signal processors, central processing units, state machines, logic circuitries, and/or any devices that manipulate signals based on operational instructions. In some cases, processor 1102 may be one or more hardware processors and/or logic circuits of any suitable type specifically programmed or configured to execute the algorithms and processes described herein. Processor 1102 can be configured to fetch and execute computer-readable instructions stored in computer-readable media 1104 or other computer-readable media. Processor 1102 can perform one or more of the functions attributed to display timing controller 104, the source driver, and/or the gate driver of display panel 106. Processor 1102 can also perform one or more functions attributed to a graphic controller (not illustrated) for the electrowetting display device.

Depending on the configuration of display device 1100, computer-readable media 1104 may be an example of tangible non-transitory computer storage media and may include volatile and nonvolatile memory and/or removable and non-removable media implemented in any type of technology for storage of information such as computer-readable instructions, data structures, program modules or other data. Computer-readable media 1104 may include, but is not limited to, RAM, ROM, EEPROM, flash memory or other computer readable media technology, CD-ROM, digital versatile disks (DVD) or other optical storage, magnetic cassettes, magnetic tape, solid-state storage and/or magnetic disk storage. Further, in some cases, display device 1100 may access external storage, such as RAID storage systems, storage arrays, network attached storage, storage area networks, cloud storage, or any other medium that can be used to store information and that can be accessed by processor 1102 directly or through another computing device or network. Accordingly, computer-readable media 1104 may be computer storage media able to store instructions, modules or components that may be executed by processor 1102.

Computer-readable media 1104 may be used to store and maintain any number of functional components that are executable by processor 1102. In some implementations, these functional components comprise instructions or programs that are executable by processor 1102 and that, when executed, implement operational logic for performing the actions attributed above to display device 1100. Functional components of display device 1100 stored in computer-readable media 1104 may include the operating system and user interface module 1106 for controlling and managing various functions of display device 1100, and for generating one or more user interfaces on display panel 106 of display device 1100.

In addition, computer-readable media 1104 may also store data, data structures and the like, that are used by the functional components. For example, data stored by computer-readable media 1104 may include user information and, optionally, one or more content items 1108. Depending on the type of display device 1100, computer-readable media 1104 may also optionally include other functional components and data, such as other modules and data 1110, which may include programs, drivers and so forth, and the data used by the functional components. Further, display device 1100 may include many other logical, programmatic and physical components, of which those described are merely examples that are related to the discussion herein. Further, while the figures illustrate the functional components and data of display device 1100 as being present on display device 1100 and executed by processor 1102 on display device 1100, it is to be appreciated that these components and/or data may be distributed across different computing devices and locations in any manner.

FIG. 11 further illustrates examples of other components that may be included in display device 1100. Such examples include various types of sensors, which may include, for example, a GPS device 1112, an accelerometer 1114, one or more cameras 1116, a compass 1118, a gyroscope 1120, and/or a microphone 1122.

Display device 1100 may further include one or more communication interfaces 1124, which may support both wired and wireless connection to various networks, such as cellular networks, radio, Wi-Fi networks, close-range wireless connections, near-field connections, infrared signals, local area networks, wide area networks, and/or the Internet, for example. Communication interfaces 1124 may further allow a user to access storage on or through another device, such as a remote computing device, a network attached storage device, or cloud storage.

Display device 1100 may further be equipped with one or more speakers 1126 and various other input/output (I/O) components 1128. Such I/O components 1128 may include, for example, a touchscreen and various user controls (e.g., buttons, a joystick, a keyboard, and/or a keypad), a haptic or tactile output device, connection ports, and/or physical condition sensors. For example, operating system 1106 of display device 1100 may include suitable drivers configured to accept input from a keypad, keyboard, or other user controls and devices included as I/O components 1128. Additionally, display device 1100 may include various other components that are not shown, examples of which include removable storage, a power source, such as a battery and power control unit, and/or a PC Card component.

In example embodiments described herein, a display device includes an electrowetting display including a plurality of even rows and odd rows of pixels. The display device also includes a display timing controller coupled to the plurality of rows of pixels and including a single-frame buffer memory having a size to store no more than an amount of data approximately equal to a single processed complete image frame. The display timing controller is configured to write image data to the electrowetting display in an interlaced writing technique. The display timing controller is also configured to, during a first interlaced frame write time: write existing odd row image data located at odd row memory locations within the single-frame buffer memory to the odd rows of pixels, receive even row image data of a first processed complete image frame, and store the even row image data in the single-frame buffer memory at even row memory locations within the single-frame buffer memory while abstaining from overwriting the existing odd row image data located at the odd row memory locations. During a second interlaced frame write time, the interlaced display timing controller is configured to write the even row image data located at the plurality of even row memory locations to the even rows of pixels, receive new odd row image data of a second processed complete image frame; and store the new odd row image data in the single-frame buffer memory at the odd row memory locations while abstaining from overwriting the even row image data located at the even row memory locations.

In another embodiment, a method includes, at a display timing controller coupled to a display including first and second rows of pixels, the display timing controller including a single-frame buffer memory having a size to store no more than an amount of data approximately equal to a single processed complete image frame, during a first frame write time: reading, from the single-frame buffer memory, existing first image data located at first memory locations within the single-frame buffer memory, writing the existing first image data to the first rows of pixels, and storing second image data of a first processed complete image frame in the single-frame buffer memory at second memory locations within the single-frame buffer memory while maintaining odd row image data in the single-frame buffer memory. During a second frame write time occurring after the first frame write time: reading, from the single-frame buffer memory, the second image data located at the second memory locations, writing the second image data to the second rows of pixels, and storing third image data in the single-frame buffer memory at the first memory locations while maintaining second image data in the single-frame buffer memory.

In another embodiment, a display timing controller includes a single-frame buffer memory having a size to store no more than an amount of data approximately equal to a single processed complete image frame. The display timing controller may, during a first frame write time, read, from the single-frame buffer memory, existing first image data located at first memory locations within the single-frame buffer memory, write the existing first image data to first rows of pixels of a display, and store second image data of a first processed complete image frame in the single-frame buffer memory at second memory locations within the single-frame buffer memory while maintaining the first image data in the single-frame buffer memory. The display timing controller may also, during a second frame write time occurring after the first frame write time, read, from the single-frame buffer memory, the second image data located at the second memory locations, write the second image data to second rows of pixels of the display, and store third image data in the single-frame buffer memory at the first memory locations while maintaining the second image data in the single-frame buffer memory.

Various instructions, methods and techniques described herein may be considered in the general context of computer-executable instructions, such as program modules stored on computer storage media and executed by the processors herein. Generally, program modules include, for example, routines, programs, objects, components, and/or data structures, for performing particular tasks or implementing particular abstract data types. These program modules, and the like, may be executed as native code or may be downloaded and executed, such as in a virtual machine or other just-in-time compilation execution environment. Typically, the functionality of the program modules may be combined or distributed as desired in various implementations. An implementation of these modules and techniques may be stored on computer storage media or transmitted across some form of communication.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims. One skilled in the art will realize that a virtually unlimited number of variations to the above descriptions are possible, and that the examples and the accompanying figures are merely to illustrate one or more examples of implementations. It will be understood by those skilled in the art that various other modifications can be made, and equivalents can be substituted, without departing from claimed subject matter. Additionally, many modifications can be made to adapt a particular situation to the teachings of claimed subject matter without departing from the central concept described herein. Therefore, it is intended that claimed subject matter not be limited to the particular embodiments disclosed, but that such claimed subject matter can also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter can be practiced without these specific details. In other instances, methods, devices, or systems that would be known by one of ordinary skill have not been described in detail so as not to obscure claimed subject matter.

Reference throughout this specification to "one embodiment" or "an embodiment" can mean that a particular feature, structure, or characteristic described in connection with a particular embodiment can be included in at least one embodiment of claimed subject matter. Thus, appearances of the phrase "in one embodiment" or "an embodiment" in various places throughout this specification are not necessarily intended to refer to the same embodiment or to any one particular embodiment described. Furthermore, it is to be understood that particular features, structures, or characteristics described can be combined in various ways in one or more embodiments. In general, of course, these and other issues can vary with the particular context of usage. Therefore, the particular context of the description or the usage of these terms can provide helpful guidance regarding inferences to be drawn for that context.

What is claimed is:

1. An electrowetting display device, comprising:

an electrowetting display including a plurality of pixels arranged in a first plurality of even rows of pixels and a second plurality of odd rows of pixels;

a display timing controller coupled to the plurality of pixels, the display timing controller comprising a single-frame buffer memory having a size to store no more than an amount of data approximately equal to a single processed complete image frame, the display timing controller configured to write image data to the electrowetting display according to an interlaced writing technique, the display timing controller further configured to:

during a first frame write time:

write, to the first plurality of odd rows of pixels, existing odd row image data located at a plurality of odd row memory locations within the single-frame buffer memory;

receive even row image data of a first processed complete image frame;

store the even row image data in the single-frame buffer memory at a plurality of even row memory locations within the single-frame buffer memory and maintain the existing odd row image data in the plurality of odd row memory locations; and during a second frame write time:

write, to the second plurality of even rows of pixels, the even row image data;

receive new odd row image data of a second processed complete image frame; and store the new odd row image data in the single-frame buffer memory at the plurality of odd row memory locations and maintain the even row image data at the plurality of even row memory locations; and a video processing device coupled to the interlaced display timing controller, wherein the video processing device is configured to:

prior to the first frame write time:

receive a first complete image frame from a host system; and perform at least one image processing procedure on the first complete image frame to generate the first processed complete image frame, the first processed complete image frame including the even row image data and first image frame odd row image data corresponding to the second plurality of odd rows of pixels; and during the first frame write time:

communicate the even row image data to the display timing controller.

2. The electrowetting display device of claim 1, wherein the interlaced display timing controller is further configured to:

during the first interlaced frame write time, read the existing odd row image data concurrently with storing the even row image data; and during the second interlaced frame write time, read the even row image data concurrently with storing the new odd row image data.

3. The electrowetting display device of claim 1, wherein the video processing device is further configured to:

prior to the second frame write time:

receive a second complete image frame from the host system;

perform at least one image processing procedure on the second complete image frame to generate the second processed complete image frame configured for display on the electrowetting display, the second processed complete image frame including the new odd row image data; and overwrite the first image frame odd row image data with the new odd row image data; and during the second frame write time:

communicate the new odd row image data to the display timing controller.

4. A method, comprising:

at a display timing controller coupled to a display, the display including a first plurality of rows of pixels and a second plurality of rows of pixels, the display timing controller comprising a single-frame buffer memory having a size to store no more than an amount of data approximately equal to a single processed complete image frame:

during a first write time:

reading existing first image data for the first plurality of rows of pixels, the first image data located at a first plurality of memory locations within the single-frame buffer memory corresponding to the first plurality of rows of pixels;

writing the existing first image data to the first plurality of rows of pixels; and storing second image data for the second plurality of rows of pixels in the single-frame buffer memory at a second plurality of memory locations within the single-frame buffer memory corresponding to the second plurality of rows of pixels while maintaining the existing first image data in the single-frame buffer memory, the second image data being of a first processed complete image frame; and during a second write time, the second write time occurring after the first write time:

reading the second image data located at the second plurality of memory locations;

writing the second image data to the second plurality of rows of pixels; and storing third image data in the single-frame buffer memory at the first plurality of memory locations while maintaining second image data in the second plurality of memory locations;

the method further comprising:

at a video processing device having an output coupled to an input of the display timing controller and having an input coupled to a host system:

receiving a first complete image frame from the host system;

performing at least one video processing procedure on the first complete image frame to generate the first processed complete image frame configured for display on the display, the first processed complete image frame including the second image data corresponding to the second plurality of rows of pixels and other image data corresponding to the first plurality of rows of pixels; and communicating the second image data to the display timing controller during the first write time.

5. The method of claim 4, further comprising:

during the first write time:

reading, from the single-frame buffer memory, the existing first image data, wherein the existing first image data comprises all odd row image data for a corresponding existing processed complete image frame; and during the second write time:

reading, from the single-frame buffer memory, the second image data, wherein the second image data comprises all the even row image data for the first processed complete image frame.

6. The method of claim 4, further comprising:

during the first write time:

reading the existing first image data concurrently with storing the second image data; and during the second write time:

reading the second image data concurrently with storing the third image data.

7. The method of claim 4, further comprising, at the video processing device, communicating the other image data to the display timing controller during the second write time as the third image data.

8. The method of claim 4, further comprising, at the video processing device:

receiving a second complete image frame from the host system;

performing at least one image processing procedure on the second complete image frame to generate a second processed complete image frame configured for display on the display, the second processed complete image frame including the third image data corresponding to the first plurality of rows of pixels; and communicating the third image data to the display timing controller during the second write time.

9. The method of claim 4, further comprising:

during the first write time:

performing a pixel reset procedure on the first plurality of rows of pixels prior to writing the existing first image data to the first plurality of rows of pixels; and during the second write time:

performing a pixel reset procedure on the second plurality of rows of pixels prior to writing the second image data to the second plurality of rows of pixels.

10. The method of claim 9, further comprising, at the display timing controller:

during the first write time:

performing a first pixel reset procedure on a first subset of the first plurality of rows of pixels;

writing, to the first subset of the first plurality of rows, the existing first image data corresponding to the first subset of the first plurality of rows located at the first plurality of memory locations within the single-frame buffer memory after performing the first pixel reset procedure;

performing a second pixel reset procedure on a second subset of the first plurality of rows of pixels after writing to the first subset of the first plurality of rows, the second subset of the first plurality of rows being different from the first subset of the first plurality of rows; and writing, to the second subset of the first plurality of rows, the existing first image data corresponding to the second subset of the first plurality of rows located at the first plurality of memory locations within the single-frame buffer memory after performing the second pixel reset procedure; and during the second write time:

performing a third pixel reset procedure on a first subset of the second plurality of rows of pixels;

writing, to the first subset of the second plurality of rows, the second image data corresponding to the first subset of the second plurality of rows located at the second plurality of memory locations within the single-frame buffer memory after performing the third pixel reset procedure;

performing a fourth pixel reset procedure on a second subset of the second plurality of rows of pixels after writing to the first subset of the second plurality of rows, the second subset of the second plurality of rows being different from the first subset of the second plurality of rows; and writing, to the second subset of the second plurality of rows, the second image data corresponding to the second subset of the second plurality of rows located at the second plurality of memory locations within the single-frame buffer memory after performing the fourth pixel reset procedure.

11. A display timing controller, comprising:

a single-frame buffer memory having a size to store no more than an amount of data approximately equal to a single processed complete image frame, the single-frame buffer memory comprising a dual-port memory configured to read data from the dual-port memory and write data to the dual-port memory simultaneously, the single processed complete image frame sized for display on a display and including data for the display timing controller to control operation of each individual pixel of the display, the display timing controller configured to:

during a first frame write time:

read, from the single-frame buffer memory, existing first image data located at a first plurality of memory locations within the single-frame buffer memory;

write, to a first plurality of rows of pixels of the display, the existing first image data; and store second image data of a first processed complete image frame in the single-frame buffer memory at a second plurality of memory locations within the single-frame buffer memory and maintain first image data of the first processed complete image frame in the single-frame buffer memory; and during a second frame write time, the second frame write time occurring after the first frame write time:

read, from the single-frame buffer memory, the second image data located at the second plurality of memory locations;

write, to a second plurality of rows of pixels of the display, the second image data; and store third image data in the single-frame buffer memory at the first plurality of memory locations and maintain second image data in the single-frame buffer memory.

12. The display timing controller of claim 11, wherein the display timing controller is further configured to perform read operations and store operations at a memory operating frequency, wherein the memory operating frequency is at least twice as fast as a writing frequency of the display.

13. The display timing controller of claim 11, wherein the display timing controller is part of a display device and is coupled to a video processing device, the video processing device configured to:

prior to the first frame write time:

receive a first complete image frame from a host system; and perform at least one video processing procedure on the first complete image frame to generate the first processed complete image frame configured for display on the display, the first processed complete image frame including the second image data corresponding to the second plurality of rows of pixels and other image data corresponding to the first plurality of rows of pixels; and during the first frame write time:

communicate the second image data to the display timing controller.

14. The display timing controller of claim 13, wherein the video processing device is further configured to communicate the other image data of the first processed complete image frame to the display timing controller during the second frame write time as the third image data.

15. The display timing controller of claim 13, wherein the video processing device is further configured to:

prior to the second frame write time:

receive a second complete image frame from the host system;

perform at least one image processing procedure on the second complete image frame to generate a second processed complete image frame configured for display on the display, the second processed complete image frame including the third image data corresponding to the first plurality of rows of pixels; and during the second frame write time:

communicate the third image data to the display timing controller.

16. The display timing controller of claim 11, wherein the display timing controller is further configured to:

during the first frame write time, perform a pixel reset procedure on the first plurality of rows of pixels prior to writing the existing first image data to the first plurality of rows of pixels; and during the second frame write time, perform a pixel reset procedure on the second plurality of rows of pixels prior to writing the second image data to the second plurality of rows of pixels.

17. The display timing controller of claim 11, wherein the display timing controller is further configured to:

write all image data to the display with an interlaced technique, wherein the interlaced technique further includes writing image data to the first plurality of rows of pixels and the second plurality of rows of pixels with a discrete interlacing interval of INT4 or greater.

18. A display timing controller, comprising:

a single-frame buffer memory having a size to store no more than an amount of data approximately equal to a single processed complete image frame, the single processed complete image frame sized for display on a display and including data for the display timing controller to control operation of each individual pixel of the display, the display timing controller configured to:

during a first frame write time:

read, from the single-frame buffer memory, existing first image data located at a first plurality of memory locations within the single-frame buffer memory;

write, to a first plurality of rows of pixels of the display, the existing first image data; and store second image data of a first processed complete image frame in the single-frame buffer memory at a second plurality of memory locations within the single-frame buffer memory and maintain first image data of the first processed complete image frame in the single-frame buffer memory; and during a second frame write time, the second frame write time occurring after the first frame write time:

read, from the single-frame buffer memory, the second image data located at the second plurality of memory locations;

write, to a second plurality of rows of pixels of the display, the second image data; and store third image data in the single-frame buffer memory at the first plurality of memory locations and maintain second image data in the single-frame buffer memory;

wherein the display timing controller is further configured to perform read operations and store operations at a memory operating frequency, wherein the memory operating frequency is at least twice as fast as a writing frequency of the display.

19. The display timing controller of claim 18, wherein the display timing controller is further configured to:

during the first frame write time, perform a pixel reset procedure on the first plurality of rows of pixels prior to writing the existing first image data to the first plurality of rows of pixels; and during the second frame write time, perform a pixel reset procedure on the second plurality of rows of pixels prior to writing the second image data to the second plurality of rows of pixels.

20. A display timing controller, comprising:

a single-frame buffer memory having a size to store no more than an amount of data approximately equal to a single processed complete image frame, the single processed complete image frame sized for display on a display and including data for the display timing controller to control operation of each individual pixel of the display, the display timing controller configured to:

during a first frame write time:

read, from the single-frame buffer memory, existing first image data located at a first plurality of memory locations within the single-frame buffer memory;

perform a pixel reset procedure on a first plurality of rows of pixels prior to writing the existing first image data to the first plurality of rows of pixels;

write, to the first plurality of rows of pixels of the display, the existing first image data; and store second image data of a first processed complete image frame in the single-frame buffer memory at a second plurality of memory locations within the single-frame buffer memory and maintain first image data of the first processed complete image frame in the single-frame buffer memory; and during a second frame write time, the second frame write time occurring after the first frame write time:

read, from the single-frame buffer memory, the second image data located at the second plurality of memory locations;

perform a pixel reset procedure on a second plurality of rows of pixels prior to writing the second image data to the second plurality of rows of pixels;

write, to the second plurality of rows of pixels of the display, the second image data; and store third image data in the single-frame buffer memory at the first plurality of memory locations and maintain second image data in the single-frame buffer memory.

21. A method, comprising:

at a display timing controller coupled to a display, the display including a first plurality of rows of pixels and a second plurality of rows of pixels, the display timing controller comprising a single-frame buffer memory having a size to store no more than an amount of data approximately equal to a single processed complete image frame, the single-frame buffer memory comprising a dual-port memory configured to read data from the dual-port memory and write data to the dual-port memory simultaneously:

during a first write time:

reading existing first image data for the first plurality of rows of pixels, the first image data located at a first plurality of memory locations within the single-frame buffer memory corresponding to the first plurality of rows of pixels;

writing the existing first image data to the first plurality of rows of pixels; and storing second image data for the second plurality of rows of pixels in the single-frame buffer memory at a second plurality of memory locations within the single-frame buffer memory corresponding to the second plurality of rows of pixels while maintaining the existing first image data in the single-frame buffer memory, storing the second image data occurring at least partially simultaneously with reading the existing first image data, the second image data being of a first processed complete image frame; and during a second write time, the second write time occurring after the first write time:

reading the second image data located at the second plurality of memory locations;

writing the second image data to the second plurality of rows of pixels; and storing third image data in the single-frame buffer memory at the first plurality of memory locations while maintaining second image data in the second plurality of memory locations, storing the third image data occurring at least partially simultaneously with reading the second image data.

22. A method, comprising:

at a display timing controller coupled to a display, the display including a first plurality of rows of pixels and a second plurality of rows of pixels, the display timing controller comprising a single-frame buffer memory having a size to store no more than an amount of data approximately equal to a single processed complete image frame:

during a first write time:

reading existing first image data for the first plurality of rows of pixels, the first image data located at a first plurality of memory locations within the single-frame buffer memory corresponding to the first plurality of rows of pixels;

writing the existing first image data to the first plurality of rows of pixels; and storing second image data for the second plurality of rows of pixels in the single-frame buffer memory at a second plurality of memory locations within the single-frame buffer memory corresponding to the second plurality of rows of pixels while maintaining the existing first image data in the single-frame buffer memory, the second image data being of a first processed complete image frame; and during a second write time, the second write time occurring after the first write time:

reading the second image data located at the second plurality of memory locations;

writing the second image data to the second plurality of rows of pixels; and storing third image data in the single-frame buffer memory at the first plurality of memory locations while maintaining second image data in the second plurality of memory locations;

wherein the method further comprises performing reading operations and storing operations at a memory operating frequency, wherein the memory operating frequency is at least twice as fast as a writing frequency of the display.

23. A method, comprising:

at a display timing controller coupled to a display, the display including a first plurality of rows of pixels and a second plurality of rows of pixels, the display timing controller comprising a single-frame buffer memory having a size to store no more than an amount of data approximately equal to a single processed complete image frame:

during a first write time:

reading existing first image data for the first plurality of rows of pixels, the first image data located at a first plurality of memory locations within the single-frame buffer memory corresponding to the first plurality of rows of pixels;

writing the existing first image data to the first plurality of rows of pixels; and storing second image data for the second plurality of rows of pixels in the single-frame buffer memory at a second plurality of memory locations within the single-frame buffer memory corresponding to the second plurality of rows of pixels while maintaining the existing first image data in the single-frame buffer memory, the second image data being of a first processed complete image frame; and during a second write time, the second write time occurring after the first write time:

reading the second image data located at the second plurality of memory locations;

writing the second image data to the second plurality of rows of pixels; and storing third image data in the single-frame buffer memory at the first plurality of memory locations while maintaining second image data in the second plurality of memory locations;

wherein the method further comprises:

during the first write time:

performing a pixel reset procedure on the first plurality of rows of pixels prior to writing the existing first image data to the first plurality of rows of pixels; and during the second write time:

performing a pixel reset procedure on the second plurality of rows of pixels prior to writing the second image data to the second plurality of rows of pixels.

* * * * *